US007517065B2

(12) United States Patent
Isono

(10) Patent No.: US 7,517,065 B2
(45) Date of Patent: Apr. 14, 2009

(54) INJET PRINTHEAD HAVING EXTERNALLY-CONNECTED TERMINATIONS STRUCTURED TO BE RESISTANT TO DAMAGE

(75) Inventor: Jun Isono, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 307 days.

(21) Appl. No.: 11/171,929

(22) Filed: Jun. 29, 2005

(65) Prior Publication Data

US 2005/0248628 A1 Nov. 10, 2005

Related U.S. Application Data

(63) Continuation-in-part of application No. 11/040,744, filed on Jan. 21, 2005, now Pat. No. 7,416,279.

(30) Foreign Application Priority Data

Jan. 23, 2004 (JP) ..... 2004-015494
Jun. 30, 2004 (JP) ..... 2004-193885

(51) Int. Cl.
*B41J 2/045* (2006.01)

(52) U.S. Cl. ..... 347/71

(58) Field of Classification Search ..... 347/70, 347/71–72

See application file for complete search history.

(56) References Cited

U.S. PATENT DOCUMENTS 6,595,628 B2 7/2003 Takagi et al.
6,631,981 B2 10/2003 Isono et al.
7,055,936 B2 6/2006 Imai et al.
7,370,943 B2 5/2008 Imai et al.
2002/0196315 A1* 12/2002 Isono et al. ..... 347/71
2003/0063449 A1 4/2003 Suzuki et al.
2004/0041885 A1* 3/2004 Hirota ..... 347/72
2004/0160494 A1* 8/2004 Isono et al. ..... 347/68

FOREIGN PATENT DOCUMENTS

JP 11-147311 6/1999
JP 2002-19102 1/2002
JP 2002254657 9/2002
JP A-2002-254657 9/2002
JP A-2003-159795 6/2003
JP 2004114609 4/2004
JP 2004160942 6/2004

* cited by examiner

*Primary Examiner*—Luu Matthew
*Assistant Examiner*—Lisa M Solomon
(74) *Attorney, Agent, or Firm*—Reed Smith LLP

(57) ABSTRACT

An inkjet printhead is disclosed which includes nozzles for ejecting ink droplets; a cavity unit incorporating pressure chambers; and an actuator in the form of a laminate of sheets. The actuator includes individual electrodes and a top sheet having bonding terminations. The inkjet printhead is bonded at the bonding terminations to a flexible flat cable. The bonding terminations include surface electrodes formed on the top sheet. The top sheet includes through holes, each of which is filled with a conductive material locally communicated with a corresponding one of the surface electrodes at a communication portion thereof. The top sheet includes external conductive areas, each formed on a surface of a corresponding one of the surface electrodes, and each having a thickness larger than that of the corresponding surface electrode. Each of the external conductive areas overlays an open end of the corresponding through hole located in the communication portion.

11 Claims, 14 Drawing Sheets

INJET PRINTHEAD HAVING EXTERNALLY-CONNECTED TERMINATIONS STRUCTURED TO BE RESISTANT TO DAMAGE

CROSS-REFERENCE TO RELATED APPLICATIONS

This is a continuation-in-part application of application Ser. No. 11/040,744 filed Jan. 21, 2005, now U.S. Pat. No. 7,416,279.

This application is based on Japanese Patent Applications No. 2004-015494 filed 23 Jan., 2004, and No. 2004-193885 filed 30 Jun. 2004, and U.S. Utility patent application Ser. No. 11/040,744 filed Jan. 21, 2005, the contents of which are incorporated hereinto by reference.

BACKGROUND OF THE INVENTION

1. Field of the Invention

The invention relates to a structure employed in an inkjet printhead for externally and electrically connecting the inkjet printhead, and more particularly to bonding terminations of an inkjet printhead having an actuator, wherein the bonding terminations are formed on the surface of the actuator for allowing its electrical connection with a flexible flat cable for use in transmission of control signals.

2. Description of the Related Art

Various types of inkjet printheads are known which include an on-demand type. An example of a conventional inkjet printhead of an on-demand type is constructed, as disclosed in Japanese Patent Publication No. 2002-19102, etc., such that a cavity unit in the form of a laminate of a plurality of plates incorporates a plurality of pressure chambers arranged in two rows. The cavity unit is joined to an actuator (a piezoelectric actuator, for example) having a plurality of active areas (ink ejecting energy generation areas) corresponding to the respective pressure chambers.

Further, in this example, surface electrodes are arranged in rows on the upper face (surface) of the actuator at its both edges extending longitudinally. The surface electrodes function as bonding terminations corresponding to the active areas of the actuator, for use in application of voltage to the active areas.

Still further, in this example, the surface electrodes (bonding terminations) of the actuator are bonded to bonding terminations of a flexible flat cable for use in transmission of external control signals, in superposed relationship thereon.

In an example of an inkjet printhead disclosed in the aforementioned Japanese Patent Publication No. 2002-19102, the actuator is constructed with a plurality of first green sheets; a plurality of second green sheets; and a top plate, all of which are ceramic bodies each made up of a piezoelectric material, for example.

Each one of the first green sheets includes patterns for individual electrodes formed on the surface of each first green sheet. Each one of the second green sheets includes a pattern of a common electrode formed on the surface of each second green sheet. The top plate includes surface electrodes for individual connection and surface electrodes for common connection formed on the surface of the top plate.

In this example, for constructing the actuator operable for ejecting ink droplets, the first and second green sheets are alternately superposed on each other, resulting in a laminate thereof, and the top plate is superposed on the uppermost one of the laminated sheets. The ultimate laminate of the sheets and the top plate is pressed and fired.

In this example, during above process, the individual electrodes and the common electrodes are formed on the surfaces of the sheets.

Ones of the individual electrodes (on the sheets) corresponding in position to each other as viewed in a lamination direction of the sheets are required to be electrically connected together. Each one of the surface electrodes (on the top plate) for individual connection and one of the individual electrodes (on the sheets) which corresponds in position to each surface electrode as viewed in the lamination direction are required to be electrically connected together, as well.

Ones of the common electrodes (on the sheets) corresponding in position to each other as viewed in the lamination direction are required to be electrically connected together. Each one of the surface electrodes (on the top plate) for common connection and one of the common electrodes (on the sheets) which corresponds in position to each surface electrode as viewed in the lamination direction are required to be electrically connected together, as well.

For achieving the above electrical connection between the sheets and the top plate, these sheets and top plate are pierced to form the respective through holes piercing through the sheets and top plate thickness wise, and these through holes are filled with conductive paste, during the formation of the individual electrodes and the common electrodes on the surfaces of the sheets.

These individual electrodes and common electrodes and the surface electrodes conductive thereto are formed by applying Ag (Silver)-Pd (Palladium)-based conductive paste onto the sheets and the top plate by a screen printing technique.

Another example of a conventional inkjet printhead is disclosed in Japanese Patent Publication No. HEI 11-147311. In this example, a flexible flat cable is constructed with a laminate of a plurality of substrate layers each having a wiring pattern formed on a single face thereof.

In this example, at least one of the plurality of substrate layers is pierced to form through holes via which the wiring patterns of other ones of the plurality of substrate layers behind the at least one substrate layer are exposed. On the exposed portions of the wiring patterns, there are formed bump electrodes (bonding electrode areas) which are bonded to surface electrodes of an actuator. These bump electrodes are typically made up of solder alloy which is softened and melted by heat.

BRIEF SUMMARY OF THE INVENTION

However, the following drawbacks are encountered in manufacturing the conventional inkjet printheads described above.

Typically, the uppermost one of laminated layers is fired at a high temperature, after the lamination press of the same layers. As a result, for the conventional inkjet printheads, surface electrodes on the uppermost layer are specially reduced in layer (film) thickness.

On the other hand, for the conventional inkjet printheads, a connection portion of each thinned surface electrode at which a conductive material has been connected is exposed to the outside. The uppermost layer includes through holes formed therethrough and extending in the thickness direction of the uppermost layer, and the through holes are each filled with the conductive material. The connection portion is located at where each through hole is connected with the front face of the uppermost layer, or at an open end of each through hole.

As a result, for the conventional inkjet printheads, the possibility arises that the connection portion chips or peels off from the uppermost layer during handling of the actuator, resulting in electrical disconnection.

In addition, an increase in dot density in printing requires an increase in the nozzle number of a cavity unit. An increase in the nozzle number causes a decrease in clearances between adjacent ones of the corresponding individual electrodes, and eventually, causes a decrease in clearances between adjacent ones of the corresponding land-shaped surface electrodes formed in the uppermost layer. A decrease in these clearances requires a decrease in area size of each land-shaped surface electrode.

Therefore, the conventional inkjet printheads each suffer the drawback that an increase in print dot density entails an increase in the possibility that undesired electrical disconnection occurs in each through hole at its open end.

It is therefore an object of the present invention to provide a structure employed in an inkjet printhead for externally and electrically connecting the inkjet printhead, with an improved resistance to damage causing undesired electrical disconnection.

According to the present invention, an inkjet printhead for ejecting ink droplets for printing is provided, which comprises a plurality of nozzles through which the ink droplets are ejected, disposed such that a plurality of nozzle arrays each extending in a first direction are arranged in a second direction orthogonal to the first direction.

The inkjet printhead further comprises a cavity unit incorporating a plurality of pressure chambers corresponding to the plurality of nozzles, respectively. The plurality of pressure chambers are disposed such that a plurality of pressure-chamber arrays each extending in the first direction are arranged in the second direction.

The inkjet printhead still further comprises an actuator including a plurality of energy generation areas selectively imparting ink ejecting energy to the plurality of pressure chambers, respectively. The actuator is in the form of a laminate of a plurality of sheets, and in superposed relationship on the cavity unit.

In the inkjet printhead, the actuator includes a plurality of individual electrodes corresponding to the plurality of energy generation areas, respectively, and includes a top sheet of the plurality of sheets which is distal from the cavity unit.

Further, the top sheet includes a plurality of bonding terminations for selectively imparting electrical energy to the plurality of energy generation areas, respectively. The plurality of bonding terminations are disposed on a surface of the top sheet so as to form individually separated lands.

Still further, the inkjet printhead is bonded at the plurality of bonding terminations to a plurality of bonding electrode areas of a flexible flat cable, respectively, in superposed relationship thereon. The inkjet printhead is for use in reception of control signals for controlling the inkjet printhead, via the flexible flat cable.

Additionally, the plurality of bonding terminations include a plurality of surface electrodes formed on a surface of the top sheet, respectively, and the top sheet includes a plurality of through holes each piercing through the top sheet in a thickness direction thereof. Each of the plurality of through holes is filled with a conductive material.

Still additionally, the conductive material filling a corresponding one of the plurality of through holes, is locally communicated with a corresponding one of the plurality of the surface electrodes at a communication portion thereof, thereby to electrically couple the corresponding surface electrode and a corresponding one of the plurality of individual electrodes of the actuator.

Further, the top sheet includes a plurality of external conductive areas, each formed on a surface of a corresponding one of the plurality of surface electrodes, and each having a thickness larger than that of the corresponding surface electrode.

Still further, each of the external conductive areas is formed, so as to overlay an open end of the corresponding through hole located in the communication portion of the corresponding surface electrode, and so as to be tightly joined to the open end.

As will be readily understood from the above explanation, in the inkjet printhead according to the present invention, each one of the through holes each piercing through the top sheet thickness-wise is filled with the corresponding conductive material, and as a result, an inner conductive electrode is formed within each through hole, in the form of a hollow body (e.g., a tube) or a solid body (e.g., a cylinder), for example.

Further, in the inkjet printhead according to the present invention, the bonding terminations on the top sheet for individual connection are disposed in correspondence with the surface electrodes on the top sheet, with the energy generation areas, and with the individual electrodes.

Therefore, in the inkjet printhead according to the present invention, each bonding termination on the top sheet for individual connection is configured, such that the open end of the corresponding through hole is overlaid or covered with the corresponding external conductive area which is thicker than the corresponding surface electrode.

As a result, the corresponding surface electrode on the top sheet is overlaid at a connection portion thereof at which the corresponding inner conductive electrode is connected, with the corresponding external conductive area. Additionally, the upper portion of the corresponding inner conductive electrode is also overlaid with the corresponding external conductive area.

Accordingly, in the inkjet printhead according to the present invention, the connection portion of the corresponding surface electrode is not be exposed, but overlaid with the thicker corresponding external conductive area.

Therefore, the inkjet printhead according to the present invention allows the connection portion between the corresponding inner conductive electrode and the corresponding surface electrode to be protected from being damaged.

Further, in the inkjet printhead according to the present invention, each external conductive area is formed on the top sheet so as to be tightly joined to the corresponding through hole at its open end, thereby allowing delicate sites of the connection portion between the corresponding inner conductive electrode and the corresponding surface electrode to be protected from being damaged, in an ensured fashion.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
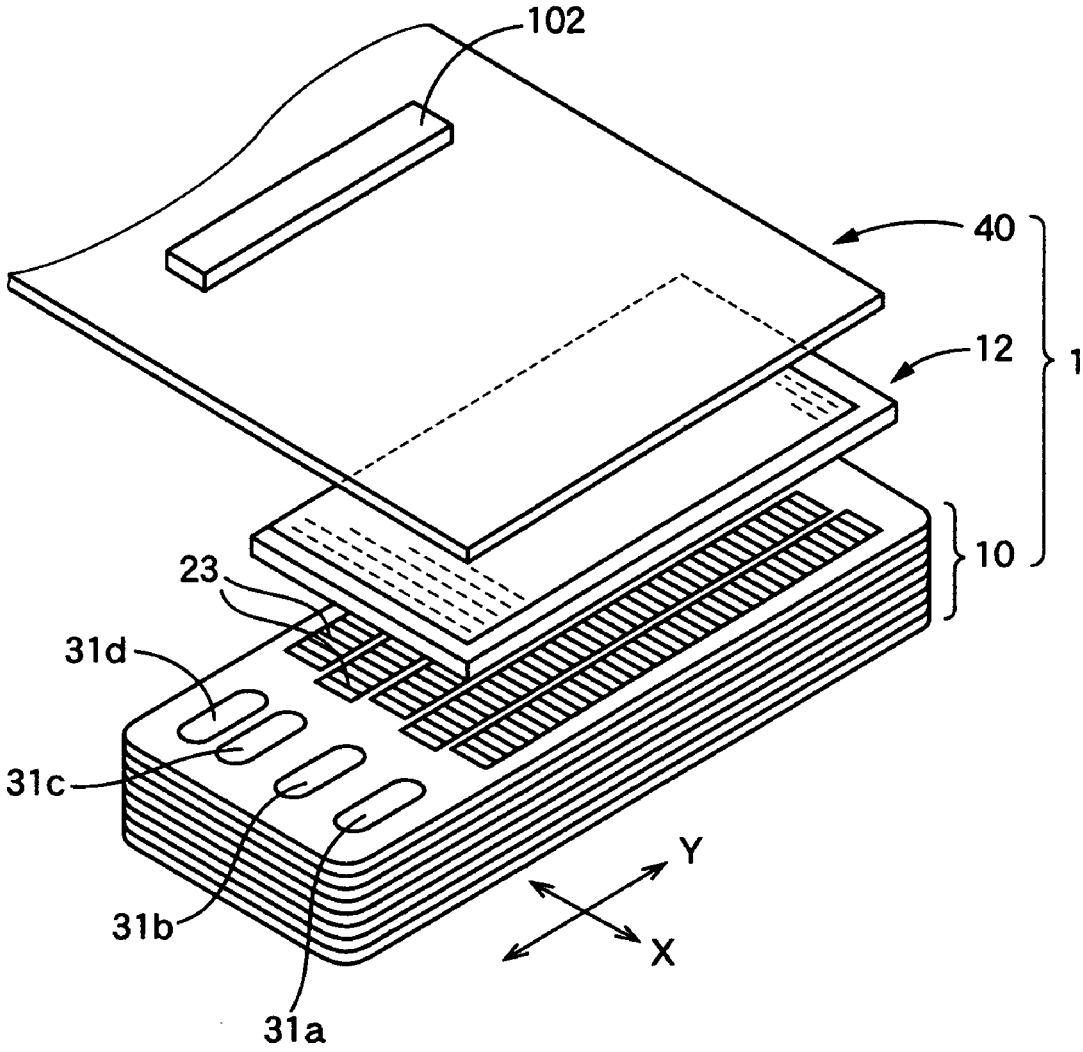
FIG. 1 is an exploded perspective view illustrating a flexible flat cable, a piezoelectric actuator, and a cavity unit, all of which are mounted on a piezoelectric inkjet printhead in accordance with a first embodiment of the present invention.

The object mentioned above may be achieved according to any one of the following modes of this invention.

These modes will be stated below such that these modes are sectioned and numbered, and such that these modes depend upon the other mode or modes, where appropriate. This is for a better understanding of some of a plurality of technological features and a plurality of combinations thereof disclosed in this description, and does not mean that the scope of these features and combinations is interpreted to be limited to the scope of the following modes of this invention.

That is to say, it should be interpreted that it is allowable to select the technological features which are stated in this description but which are not stated in the following modes, as the technological features of this invention.

Furthermore, stating each one of the selected modes of the invention in such a dependent form as to depend from the other mode or modes does not exclude a possibility of the technological features in a dependent-form mode to become independent of those in the corresponding depended mode or modes and to be removed therefrom. It should be interpreted that the technological features in a dependent-form mode is allowed to become independent according to the nature of the corresponding technological features, where appropriate.

(1) An inkjet printhead for ejecting ink droplets for printing, the inkjet printhead comprising:

a plurality of nozzles through which the ink droplets are ejected, disposed such that a plurality of nozzle arrays each extending in a first direction are arranged in a second direction orthogonal to the first direction;

a cavity unit incorporating a plurality of pressure chambers corresponding to the plurality of nozzles, respectively, the plurality of pressure chambers being disposed such that a plurality of pressure-chamber arrays each extending in the first direction are arranged in the second direction; and an actuator including a plurality of energy generation areas selectively imparting ink ejecting energy to the plurality of pressure chambers, respectively, the actuator being in the form of a laminate of a plurality of sheets, and in superposed relationship on the cavity unit, wherein the actuator includes a plurality of individual electrodes corresponding to the plurality of energy generation areas, respectively, and includes a top sheet of the plurality of sheets which is distal from the cavity unit, wherein the top sheet includes a plurality of bonding terminations for selectively imparting electrical energy to the plurality of energy generation areas, respectively, the plurality of bonding terminations being disposed on a surface of the top sheet so as to form individually separated lands, wherein the inkjet printhead is bonded at the plurality of bonding terminations to a plurality of bonding electrode areas of a flexible flat cable, respectively, in superposed relationship thereon, for use in reception of control signals for controlling the inkjet printhead, via the flexible flat cable, wherein the plurality of bonding terminations include a plurality of surface electrodes formed on a surface of the top sheet, respectively, wherein the top sheet includes a plurality of through holes each piercing through the top sheet in a thickness direction thereof, each of the plurality of through holes being filled with a conductive material, wherein the conductive material filling a corresponding one of the plurality of through holes, is locally communicated with a corresponding one of the plurality of the surface electrodes at a communication portion thereof, thereby to electrically couple the corresponding surface electrode and a corresponding one of the plurality of individual electrodes of the actuator, wherein the top sheet includes a plurality of external conductive areas, each formed on a surface of a corresponding one of the plurality of surface electrodes, and each having a thickness larger than that of the corresponding surface electrode, and wherein each of the external conductive areas is formed, so as to overlay an open end of the corresponding through hole located in the communication portion of the corresponding surface electrode, and so as to be tightly joined to the open end.

As will be evident from the explanation stated in the section of "BRIEF SUMMARY OF THE INVENTION," the inkjet printhead according to the above mode (1) allows the connection portion between the corresponding inner conductive electrode and the corresponding surface electrode to be protected from being damaged.

(2) The inkjet printhead according to mode (1), wherein each of the plurality of external conductive areas is formed on the corresponding surface electrode so as to plug the open end.

(3) The inkjet printhead according to mode (1) or (2), wherein each of the plurality of external conductive areas comprises an external electrode bonded to a corresponding one of the plurality of bonding electrode areas of the flexible flat cable, in superposed relationship thereon, and wherein the plurality of surface electrodes are categorized at least into a first surface-electrode group having both the corresponding external electrode and a dummy portion not bonded to any bonding electrode area, and a second surface-electrode group having the corresponding external electrode without the dummy portion.

In the inkjet printhead according to the above mode (3), the surface electrodes are each pierced to form at least one through hole piercing through the top sheet, and the at least one through hole is each overlaid with at least one external conductive area thicker than each surface electrode.

The thus-configured external conductive areas corresponding to the surface electrodes in the top sheet are in-part used for forming external electrodes for connecting each surface electrode with the flexible flat cable, and in-part used for forming dummy portions. Such a dummy portion may be employed for preventing the corresponding surface electrode from being unexpectedly peeled or separated off from the top sheet, for example.

Therefore, the surface electrodes in the top sheet include at least one surface electrode including both the corresponding external electrode and the corresponding dummy portion. Such a surface electrode is configured, such that the corresponding dummy portion is appropriately spaced apart from the corresponding external electrode.

As a result, the inkjet printhead according to the above mode (3) allows the external electrodes to be connected with the flexible flat cable in superposed relationship thereon, without interference with the dummy portions.

Rather, the dummy portions are useful during the process for connecting the inkjet printhead with the flexible flat cable in superposed relationship thereon, because the dummy portions allow the flexible flat cable to be kept flat under pressure, in areas neighboring where the flexible flat cable is connected with the external electrodes under pressure.

(4) The inkjet printhead according to mode (3), wherein each of surface electrodes belonging to the first surface-electrode group is configured such that the corresponding external electrode is substantially distal from the dummy portion of a same surface electrode.

For each surface electrode, the corresponding external electrode may be located at a position which is within each surface electrode and which is substantially the farthest from the position of the corresponding dummy portion.

(5) The inkjet printhead according to any one of modes (1)-(4), wherein the plurality of pressure-chamber arrays are disposed in a staggered arrangement in which adjacent twos of the plurality of pressure-chamber arrays are staggered in the first direction by a half of a chamber-to-chamber pitch of each pressure-chamber array, wherein the plurality of surface electrodes are disposed in conformity with the staggered arrangement of the plurality of pressure chambers, in a manner that a plurality of surface-electrode arrays each extending in the first direction are arranged in the second direction, and in a staggered arrangement in which adjacent twos of the plurality of surface-electrode arrays are staggered in the first direction by a half of an electrode-to-electrode pitch of each surface-electrode array, wherein the plurality of surface electrodes are disposed, so as to be located in a portion of the top sheet which is between adjacent two of the plurality of pressure-chamber arrays, in proximity to each other, as viewed in a lamination direction of a laminate of the cavity unit and the actuator, and wherein each of the plurality of surface electrodes is formed so as to extend in parallel to each of the plurality of pressure chambers, and is disposed in a portion of the top sheet which is between adjacent two of the plurality of pressure chambers as viewed in each pressure-chamber array, as viewed in the lamination direction.

In the inkjet printhead according to the above mode (5), the plurality of pressure chambers are arranged in arrays located in a plane extending in the first and second directions, with these arrays being staggered as viewed in a lamination direction of the laminate of the sheets.

In correspondence with this arrangement, the plurality of surface electrodes on the top sheet for individual connection pressure chambers are arranged in arrays located in a plane extending in the first and second directions, with these arrays being staggered as viewed in the lamination direction.

Therefore, the plurality of bonding electrode areas of the flexible flat cable are arranged in the same manner as described above, namely, in a staggered arrangement as viewed in the lamination direction.

Therefore, the inkjet printhead according to the above mode (5) makes it easier to widen the clearances between adjacent twos of the bonding electrode areas of the flexible flat cable. As a result, this inkjet printhead makes it easier to assign electrical lines of a wiring pattern to the surface of the flexible flat cable, such that these electrical lines pass through the clearances between the adjacent twos of the bonding electrode areas, with these electrical lines being appropriately spaced apart.

As a result, the inkjet printhead according to the above mode (5) allows an easier reduction in mutual inductance between the electrical lines. Further, this inkjet printhead allows an easier enlargement in area size of each of the surface electrodes, and eventually allows an easier enlargement in area size of each of the corresponding external conductive areas.

This prevents the electrical connection between the inkjet printhead and the flexible flat cable from being adversely affected due to a positional difference, if any, between the external conductive areas and the bonding electrode areas, both of which are superposed on each other.

(6) The inkjet printhead according to mode (5), wherein each of the plurality of external conductive areas has a width measured in the first direction not exceeding that of the corresponding surface electrode.

(7) The inkjet printhead according to any one of modes (1)-(6), wherein the plurality of sheets are constructed by alternately laminating a plurality of first piezoelectric sheets each having ones of the plurality of individual electrodes for each of the plurality of pressure chambers, and a plurality of second piezoelectric sheets each having a common electrode common to the plurality of pressure chambers, wherein each of the plurality of second piezoelectric sheets comprises:

a plurality of through holes each piercing through each second piezoelectric sheet in a lamination direction of the plurality of sheets, each of the plurality of through holes being filled with a conductive material; and a plurality of dummy individual electrodes for allowing electrical connection between selected ones of the plurality of individual electrodes, the selected individual electrodes being located in ones of the plurality of first piezoelectric sheets which interpose each second piezoelectric sheet, the selected individual electrodes corresponding in position to each other as viewed in the lamination direction, the plurality of dummy individual electrodes being formed on each second piezoelectric sheet so as to form individually separated lands, and wherein each of the plurality of first piezoelectric sheets comprises:

a plurality of through holes each piercing through each first piezoelectric sheet in the lamination direction, each of the plurality of through holes being filled with a conductive material; and a dummy common electrode for allowing electrical connection between the common electrodes located in ones of the plurality of second piezoelectric sheets which interpose each first piezoelectric sheet, the common electrodes corresponding in position to each other as viewed in the lamination direction, the dummy common electrode being formed on each first piezoelectric sheet.

(8) The inkjet printhead according to mode (7), wherein the plurality of sheets comprise at least one constraint sheet interposed between the top sheet and one of the plurality of first and second piezoelectric sheets, wherein the constraint sheet is electrically coupled with the plurality of surface electrodes of the top sheet via the conductive material with which the through holes of the top sheet are filled, and wherein the constraint sheet comprises:

a plurality of through holes each piercing through the constraint sheet in the lamination direction, each of the plurality of through holes being filled with a conductive material;

a plurality of connection patterns electrically coupled with the plurality of individual electrodes via the conductive material filling the through holes of the constraint sheet; and a communication pattern having a conductive pattern shape identical to that of the common electrode.

The inkjet printhead according to the above mode (8), because of the employment of the at least one constraint sheet between the top sheet and other sheet(s) including the energy generation areas (e.g., a piezoelectric sheet), allows displacement or energy generated by the other sheet(s) to be effectively transmitted to the pressure chambers (9) The inkjet printhead according to mode (8), wherein the plurality of connection patterns each have a conductive pattern shape identical to those of the plurality of dummy individual electrodes.

(10) The inkjet printhead according to mode (8) or (9), wherein the plurality of through holes of the constraint sheet are out of phase with the plurality of through holes of the top sheet, as viewed in the lamination direction.

In the inkjet printhead according to the above mode (10), when pressing the bonding electrodes of the flexible flat cable onto the external conductive areas of the top sheet, a pressing force acts from the bonding electrodes of the flexible flat cable to the external conductive areas of the top sheet.

The inkjet printhead according to the above mode (10), because of the out-of-phase arrangement of the through holes of the constraint sheet and the through holes of the top sheet, allows the pressing force to be borne by the constraint sheet at its solid portions at which the through holes are not formed in the constraint sheet.

Therefore, the inkjet printhead according to the above mode (10) prevents the top sheet or the like from being unexpectedly deformed due to application of the pressing force.

(11) The inkjet printhead according to any one of modes (1)-(10), wherein the plurality of boding electrode areas comprise:

a plurality of individual surface electrodes disposed on a surface of the flexible flat cable, at respective positions corresponding to the plurality of external conductive areas of the top sheet, the plurality of individual surface electrodes being in an exposed state; and a wiring electrically coupled with the plurality of individual surface electrodes, disposed on the surface of the flexible flat cable, in a non-exposed state.

The inkjet printhead according to the above mode (11), in use, is combined with the flexible flat cable having the wiring which is formed on the surface of the flexible flat cable in a non-exposed state (with the wiring being overlaid with an electrically insulative material, for example).

Therefore, the inkjet printhead according to the above mode (11) prevents the wiring of the flexible flat cable and conductive areas (the aforementioned dummy portions, for example) in the top sheet, from being unexpectedly electrically shorted-circuited, even where these wiring and conductive areas are overlapped with each other as viewed in the lamination direction.

As a result, the inkjet printhead according to the above mode (11) allows the process for connecting the inkjet printhead with the flexible flat cable, to be more readily simplified, and allows the strength of the connection between the inkjet printhead and the flexible flat cable, to be more readily improved.

(12) The inkjet printhead according to mode (11), wherein the wiring is coated with a cover-lay.

Several presently preferred embodiments of the invention will be described in more detail by reference to the drawings in which like numerals are used to indicate like elements throughout.

FIG. 1 shows in exploded perspective view a head unit 1 of an inkjet printhead for color printing in accordance with a first embodiment of the present invention.

The inkjet printhead, as is known in the art, is mounted on a carriage (not shown) reciprocally moved in a direction (a primary scanning direction, hereinafter referred to as "second direction" or "X-direction") perpendicular to a direction (a secondary scanning direction, hereinafter referred to as "first direction" or "Y-direction) in which a sheet (not shown) is fed to be printed in a printer (not shown) constructed as an image forming apparatus.

The inkjet printhead includes a head holder (not shown) mounted on the carriage, which holds the head unit 1 facing a print face of the aforementioned sheet.

The image forming apparatus uses an ink cartridge (not shown) which is adapted to be filled with different colored ink, for example, four different colored ink of Cyan, Magenta, Yellow, and Black, on a color-by-color basis. The image forming apparatus is classified by a mount type in which the ink cartridge is mounted on the image forming apparatus.

An example of the mount type is an on-carriage type in which the ink cartridge is removably mounted on the inkjet printhead which functions as a movable component. In this type, each colored ink is supplied from the ink cartridge into the head unit 1.

Another example of the mount type is an off-cartridge type in which the ink cartridge is mounted not on the inkjet printhead constructed as a movable component but on a body of the aforementioned image forming apparatus, wherein the ink cartridge functions as a stationary component. In this type, each colored ink is supplied from the ink cartridge into the head unit 1 through a supply pipe (not shown) and a dumper chamber (not shown) mounted on the aforementioned carriage.

As shown in FIG. 1, the head unit 1 is constructed by laminating a cavity unit 10 in the form of a laminate of a plurality of plates and a plate-shaped piezoelectric actuator 12, and electrically connecting the piezoelectric actuator 12 to a flexible flat cable 40.

The piezoelectric actuator 12 is bonded to a selected one (an upper face in FIG. 1) of faces of the cavity unit 10 via adhesive agent or adhesive sheet. The flexible flat cable 40, as an example of a wiring substrate electrically coupled with the piezoelectric actuator 12 for electrical connection to an external device, is bonded to the piezoelectric actuator 12 at the back face thereof (an upper face in FIG. 1) in superposed relationship on the piezoelectric actuator 12.

Figure 2:
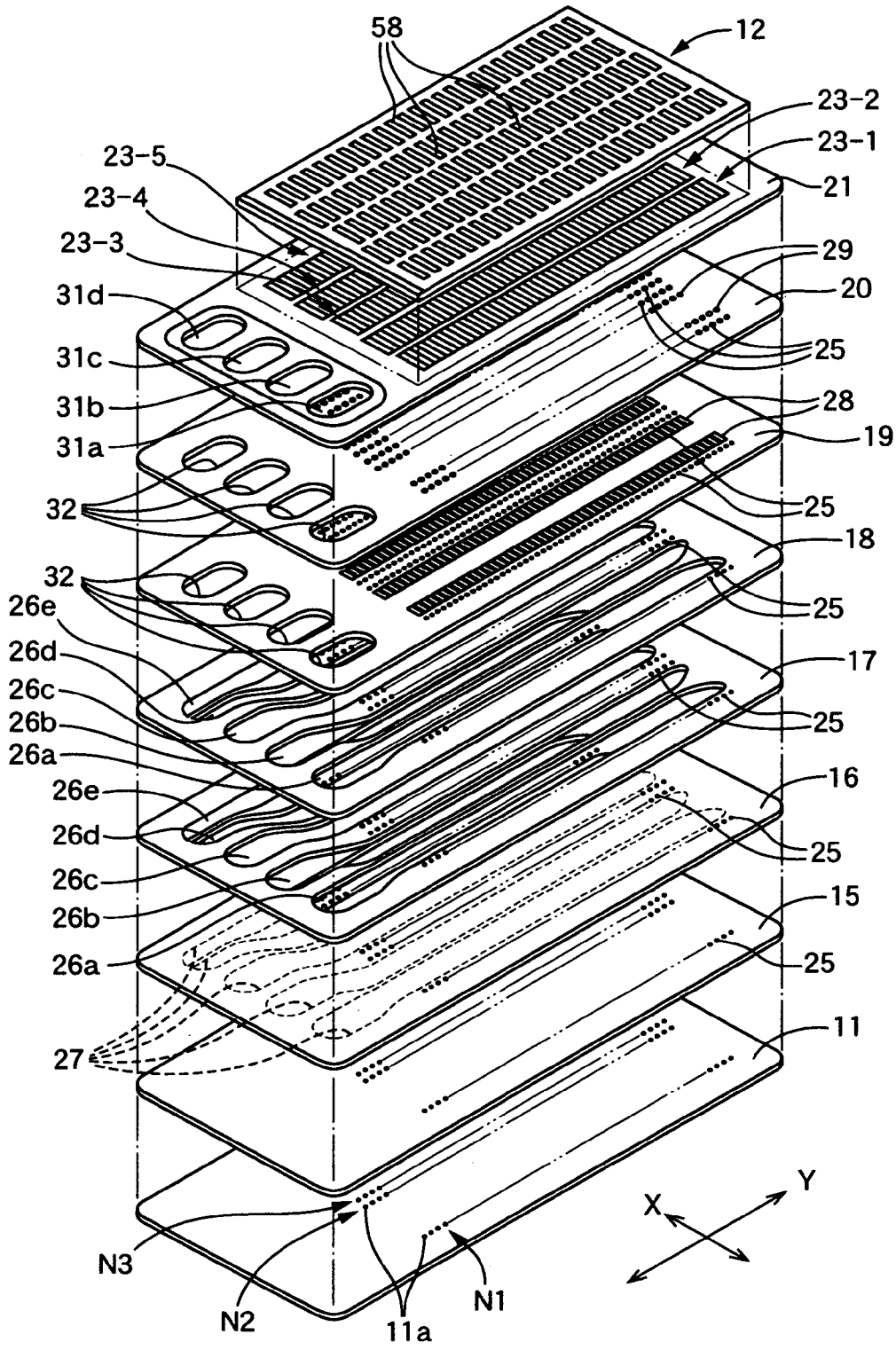
FIG. 2 is an exploded perspective view illustrating the piezoelectric actuator and the cavity unit both illustrated in FIG. 1.

FIG. 2 shows in exploded perspective view a laminate of the cavity unit 10 and the piezoelectric actuator 12. In a front face (a lower face in FIG. 2) of the cavity unit 10, a plurality of nozzle arrays N (for the present embodiment, five nozzle arrays N1 to N5 arranged from right to left as viewed in FIG. 2) are arranged in the X-direction at appropriate intervals. Each one of the nozzle arrays N has a plurality of nozzles 11*a* (see FIG. 2) arranged in the Y-direction (the first direction).

As shown in FIG. 2, the cavity unit 10 is constructed to have a laminated structure formed by bonding via adhesive agent eight flat plates in total in superposed relationship on each other, which is to say, a nozzle plate 11; a cover plate 15; a dumper plate 16; a lower manifold plate 17; an upper manifold plate 18; a first spacer plate 19; a second spacer plate 20; and a base plate 21 having a plurality of pressure chambers 23 formed thereon, arranged from bottom to top as viewed in FIG. 2. Aside from the nozzle plate 11 made of a synthetic resin, each one of the plates 15-21 is made up of a 42% nickel-alloyed steel, with a thickness of approximately 50 μm to approximately 150 μm.

As shown in FIG. 2, in the nozzle plate 11, each one of the nozzle arrays N1, N2, N3, N4, and N5 (N4 and N5 are invisible in FIG. 2), has a plurality of nozzles 11*a* each for ejecting ink droplets, and each having a micro diameter (approximately 25 μm for the present embodiment). For each one of the nozzle arrays N1, N2, N3, N4, and N5, the plurality of nozzles 11*a* are arranged in Y-direction (parallel to the longitudinal direction of the cavity unit 10, and also to the first direction and the secondary scanning direction).

Each one of the nozzle arrays N1, N2, N3, N4, and N5, one inch in length, has 75 pieces of the nozzles 11*a* belonging thereto. Therefore, the plurality of nozzles 11*a* are arranged at a density of 75 dpi (dots per inch).

As shown in FIG. 2, the nozzle arrays N1, N2, N3, N4, and N5 are arranged in the X-direction (the primary scanning direction) at appropriate intervals. The nozzle arrays N1, N2, N3, N4, and N5 are staggered with each other in the Y-direction (the secondary scanning direction), thereby forming a staggered arrangement.

As shown in FIG. 2, in the present embodiment, the nozzle array N1 is for Cyan colored ink (C); the nozzle array N2 is for Yellow colored ink (Y); the nozzle array N3 is for Magenta colored ink (M); and the nozzle arrays N4 and N5 are both for Black colored ink (BK)

Each one of the lower manifold plate 17 and the upper manifold plate 18 has five arrays of elongate ink channels (corresponding to five arrays of common ink chambers 26 described later), each extending in the Y-direction. The five arrays of ink channels are formed so as to correspond to the five nozzle arrays N1-N5, respectively, and so as to pierce through each one of the plates 17 and 18 in a thickness direction thereof.

As a result of the lamination of the lower manifold plate 17 and the upper manifold plate 18 sandwiched between the first spacer plate 19 located thereabove and the dumper plate 16 located therebelow, the aforementioned five arrays of ink channels become the five arrays of common ink chambers (manifold chambers) 26.

As shown in FIG. 2, these five arrays of common ink chambers 26 are referred to as common ink chambers 26*a*, 26*b*, 26*c*, 26*d*, and 26*e*, arranged from right to left as viewed in FIG. 2. In the present embodiment, the common ink chamber 26*a* is for Cyan colored ink (C); the common ink chamber 26*b* is for Yellow colored ink (Y); the common ink chamber 26*c* is for Magenta colored ink (M); and the fourth and fifth common ink chambers 26*d* and 26*e* are both for Black colored ink (BK).

As shown in FIG. 2, the base plate 21 is pierced at one of opposite ends thereof mutually spaced apart in the Y-direction to form four ink supply ports 31 arranged in the X-direction at appropriate intervals. These four ink supply ports 31 are referred to as ink supply ports 31*a*, 31*b*, 31*c*, and 31*d*, arranged from right to left as viewed in FIG. 2. The ink supply ports 31*a*, 31*b*, and 31*c* correspond to the common ink chambers 26*a*, 26*b*, and 26*c*, respectively, while the ink supply port 31*d* corresponds in common to the common ink chambers 26*d* and 26*e*, with the ink supply port 31*d* facing one of both ends of the common ink chamber 26*d* and one of both ends of the common ink chamber 26*e* which are in proximity to each other.

Further, as shown in FIG. 2, each one of the second spacer plate 20 and the first spacer plate 19 is pierced at one of both ends thereof, to form three ink supply passages 32, 32, 32 corresponding to the positions of the ink supply ports 31*a*, 31*b*, and 31*c*, respectively. Each one of these three ink supply passages 32, 32, 32 communicates with each corresponding one of the common ink chambers 26*a*, 26*b*, and 26*c* at one of both ends thereof.

As shown in FIG. 2, the dumper plate 16, which is attached to the lower manifold plate 17 at its lower face, includes five dumper chambers 27 at respective five positions corresponding to the positions of the plurality of the common ink chambers 26, respectively. Each one of the dumper chambers 27, extending in the Y-direction, is formed on the lower face of the dumper plate 16, in the shape of a recess open only downwardly. The attachment of the cover plate 15 to the dumper plate 16 at its lower face closes five recesses corresponding to the five dumper chambers 27, resulting in the formation of the five dumper chambers 27 each of which is fully tightly enclosed.

In the cavity unit 10 described above, once the piezoelectric actuator 12 is driven, a pressure wave is produced in each one of the pressure chambers 23. The pressure wave contains not only a forward-advancing component advancing from each pressure chamber 23 toward the corresponding nozzle 11*a* via the corresponding communication passage 25, but also a backward-advancing component advancing from each pressure chamber 23 toward the corresponding common ink chamber 26, passing through a corresponding one of communication holes 29 (described later) and a corresponding one of restrictors 28 (described later) in the description order.

In the present embodiment, the backward-advancing component is absorbed because of the vibration of the damper plate 16 reduced in thickness, resulting in the prevention of what is referred to as cross talk in the art.

Figure 3:
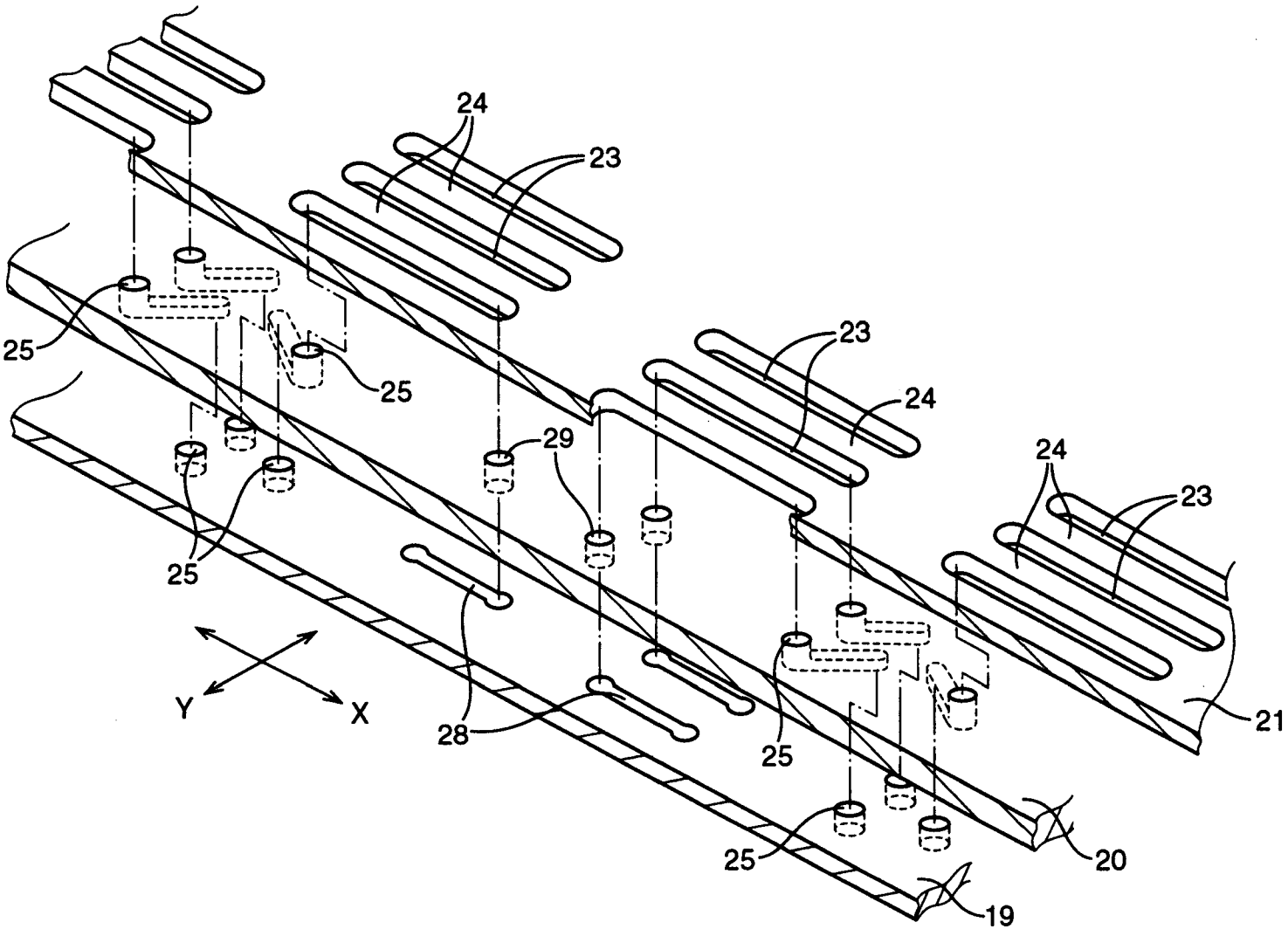
FIG. 3 is an exploded perspective view partially illustrating in enlargement the cavity unit illustrated in FIG. 2.

As shown in FIGS. 2 and 3, the first spacer plate 19 includes a plurality of restrictors 28 corresponding to each one of the nozzles 11*a*, on a per nozzle-array basis. Each one of the restrictors 28 is formed as a concave groove or an upwardly open groove having a slightly large length in the X-direction and a small width in the Y-direction.

As shown in FIG. 3, each one of the restrictors 28 communicates, at one of both ends thereof (a first end), with a corresponding one of the common ink chambers 26*a*-26*e* in the manifold plate 18. In contrast, each one of the restrictors 28 communicates, at the other of both ends thereof (a second end), with one of a plurality of communication holes 29 each piercing vertically through the second spacer plate 20 located above the restrictors 28, as described later.

As shown in FIGS. 2 and 3, a plurality of communication passages 25 are formed in the cover plate 15, the dumper plate 16, the two manifold plates 17 and 18, and the first and second spacer plates 19 and 20. The plurality of communication passages 25, each communicating with each one of the nozzles 11*a*, are formed so as not to be overlapped vertically with the common ink chambers 26 and the dumper chambers 27, and so as to pierce vertically through all the cover plate 15, the dumper plate 16, the two manifold plates 17 and 18, and the spacer plates 19 and 20. The communication passages 25 are arranged in a plurality of coextending arrays corresponding to the respective nozzle arrays N.

As shown in FIG. 2, the base plate 21 includes a plurality of pressure chambers 23 each extending in the X-direction with a small width. The plurality of pressure chambers 23 are arranged in a plurality of coextending pressure-chamber-arrays, which correspond to the respective nozzle arrays N, and which are referenced 23-1, 23-2, 23-3, 23-4, and 23-5, respectively. For each pressure-chamber array, the associated pressure chambers 23, the number of which depends on that of the associated nozzles 11*a*, are arranged in the Y-direction so as to pierce through the base plate 21 in its thickness direction.

As shown in FIG. 3, each one of the pressure chambers 23 communicates, at one of both ends thereof mutually spaced apart in the longitudinal direction (the X-direction), with each corresponding one of the restrictors 28 at the other end (i.e., the aforementioned second end) thereof formed in the first spacer plate 19, via each corresponding one of the communication holes 29 each piercing through the second spacer plate 20.

In contrast, each one of the pressure chambers 23 communicates, at the other of the both ends thereof, with each corresponding one of the communication passages 25 each piercing through the second spacer plate 20.

For each one of the pressure-chamber-arrays, the associated pressure chambers 23 are arranged in the Y-direction such that adjacent two of them interpose a corresponding one of division walls 24. Ones of the pressure chambers 23 which belong to each one of the pressure-chamber-arrays are staggered relative to ones of the pressure chambers 23 which belong to another one of the pressure-chamber-arrays, in the Y-direction, by a half of a chamber-to-chamber pitch of the associated pressure chambers 23, thereby forming a so-called staggered arrangement of the total number of the pressure chambers 23.

With the configuration described above, as shown in FIG. 2, each colored ink, once flown from each ink supply port 31*a*-31*d* into the corresponding common ink chamber 26, is distributed to the plurality of pressure chambers 23, after passing the corresponding restrictor 28 and the corresponding communication hole 29 in the description order. Each colored ink, upon delivery to each pressure chamber 23, is then supplied therefrom to the corresponding nozzle 11*a* through the corresponding communication passage 25.

Next, the construction of the piezoelectric actuator 12 will be described.

Figure 4:
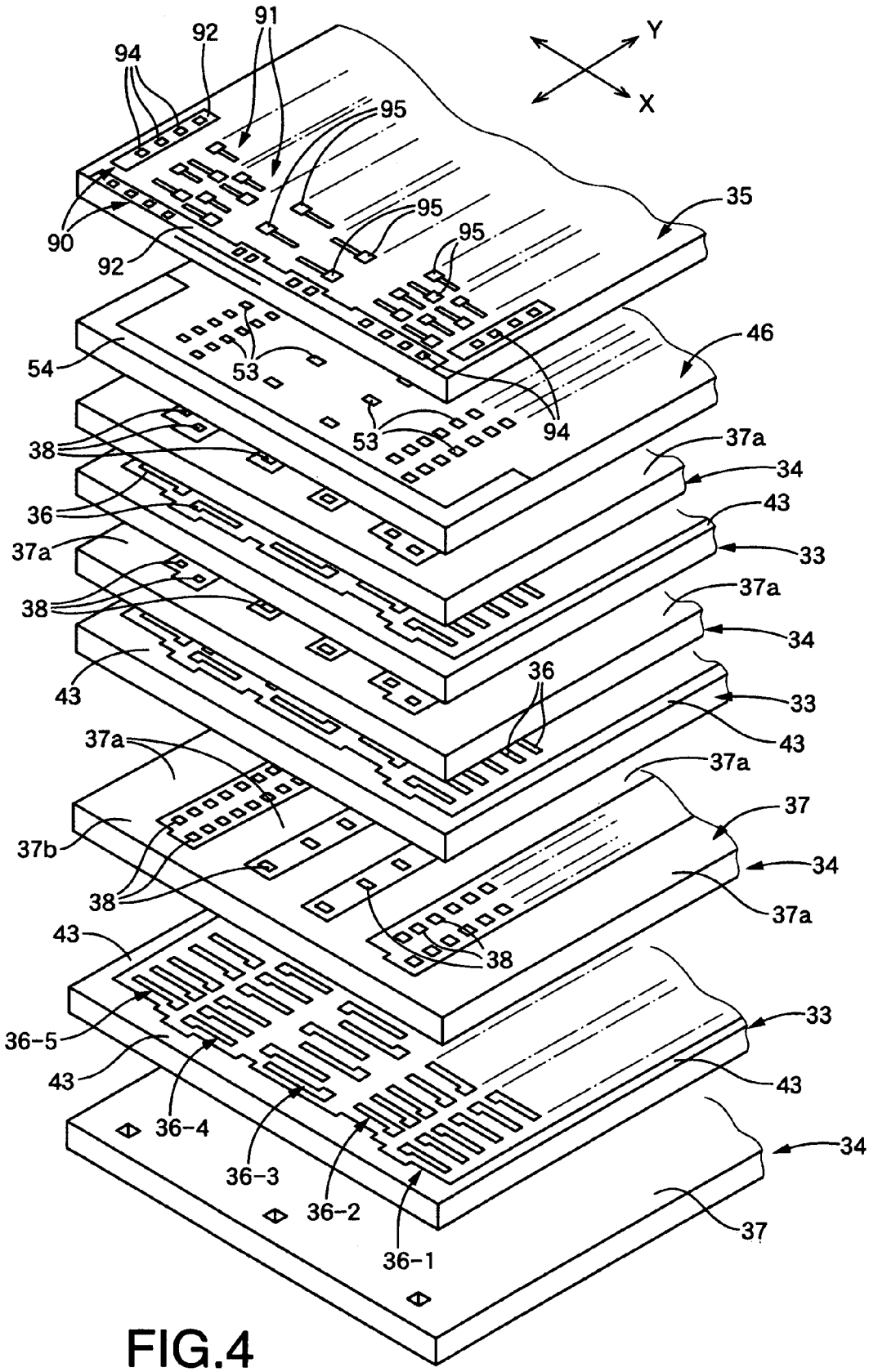
FIG. 4 is an exploded perspective view partially illustrating in enlargement the piezoelectric actuator illustrated in FIG. 2.

As shown in FIG. 4, the piezoelectric actuator 12 is, described in greater detail later, in the form of a laminate of a plurality of piezoelectric sheets 33, 34 each sandwiched thickness-wise between a plurality of individual electrodes 36 and a common electrode 37.

The piezoelectric actuator 12 includes portions of each piezoelectric sheet 33, 34 which are respectively sandwiched thickness-wise between the individual electrodes 36 and the common electrode 37, which portions function as respective active areas (energy generation areas).

Upon application of a voltage between a selected one of the individual electrodes 36 and the common electrode 37, strain in the lamination direction of the piezoelectric sheets 33, 34 due to the longitudinal piezoelectric effect occurs at one of the active areas of the piezoelectric sheets 33 and 34 which corresponds to the selected individual electrode 36.

For each one of the piezoelectric sheets 33, 34, the active areas are formed so as to be equal in number to the pressure chambers 23. Ones of the active areas which belong to each one of the piezoelectric sheets 33, 34 are formed so as to correspond in position to the pressure chambers 23, respectively. The active areas are arranged in a plurality of coextending arrays corresponding to the respective pressure-chamber-arrays.

More specifically, the plurality of active areas are arranged in a plurality of arrays each extending in an array direction (the first direction or the Y-direction) of each corresponding one of the arrays of the nozzles 11*a* (corresponding to the pressure chambers 23). The arrays of the active areas are arranged in the second direction (the X-direction) so as to be equal in number to the nozzle arrays N (five arrays for the present embodiment).

Each one of the active areas is formed so as to extend in the second direction (the width direction of the cavity unit 10 or the X-direction) or the longitudinal direction of the corresponding pressure chamber 23. The plurality of active areas are arranged, similarly with the plurality of pressure chambers 23, in a staggered arrangement, with adjacent two of them being mutually spaced a given pitch P apart.

Still more specifically, as shown in FIG. 4, the piezoelectric actuator 12 employed in the present embodiment includes a sheet set of a plurality of alternately-laminated piezoelectric sheets 33, 34 (seven sheets in total for the present embodiment), each of which is made up of a piezoelectric ceramic plate with a thickness of approximately 30 μm. A constraint layer comprised of a single sheet 46 is superposed on the upper face of the sheet set, and further, a top sheet 35 as a surface sheet is superposed on the upper face of the sheet 46.

The sheet 46 for the constraint layer and the top sheet 35 may be respectively made of a piezoelectric ceramic plate, or any one of other materials, provided that it is electrically insulative.

As shown in FIG. 4, electrode patterns of the plurality of individual electrodes 36 are formed using a screen printing technique so as to be arranged in arrays coextending in the first direction (the longitudinal direction of the piezoelectric sheet 33, the Y-direction, or the array direction of each nozzle array N), at the piezoelectric sheets 33 (even-numbered ones of the plurality of alternately-laminated piezoelectric sheets 33 and 34) on their upper faces (flat surfaces).

For clarity, the plurality of alternately-laminated piezoelectric sheets 33 and 34 have been successively numbered from one of the piezoelectric sheets 34 which forms the lowermost layer of the aforementioned sheet set and which includes the common electrode 37.

More specifically, each one of the individual electrodes 36 is patterned, for each corresponding one of the pressure chambers 23 (see FIG. 2) within the cavity unit 11, on the upper face of each one of the piezoelectric sheets 33, at a position to which the corresponding pressure chamber 23 corresponds and which is located right above the corresponding pressure chamber 23. Each individual electrode 36 is patterned so as to extend in the X-direction with a small width.

As shown in FIG. 4, although which partially illustrates each piezoelectric sheet 33, the individual electrodes 36 are arranged in a plurality of coextending arrays the number of which is equal to that of the arrays of the pressure chambers 23. The arrays of the individual electrodes 36 are referred to as individual-electrode-arrays 36-1, 36-2, 36-3, 36-4, and 36-5, respectively, in correspondence with the pressure-chamber-arrays 23-1, 23-2, 23-3, 23-4, and 23-5.

Figure 7:
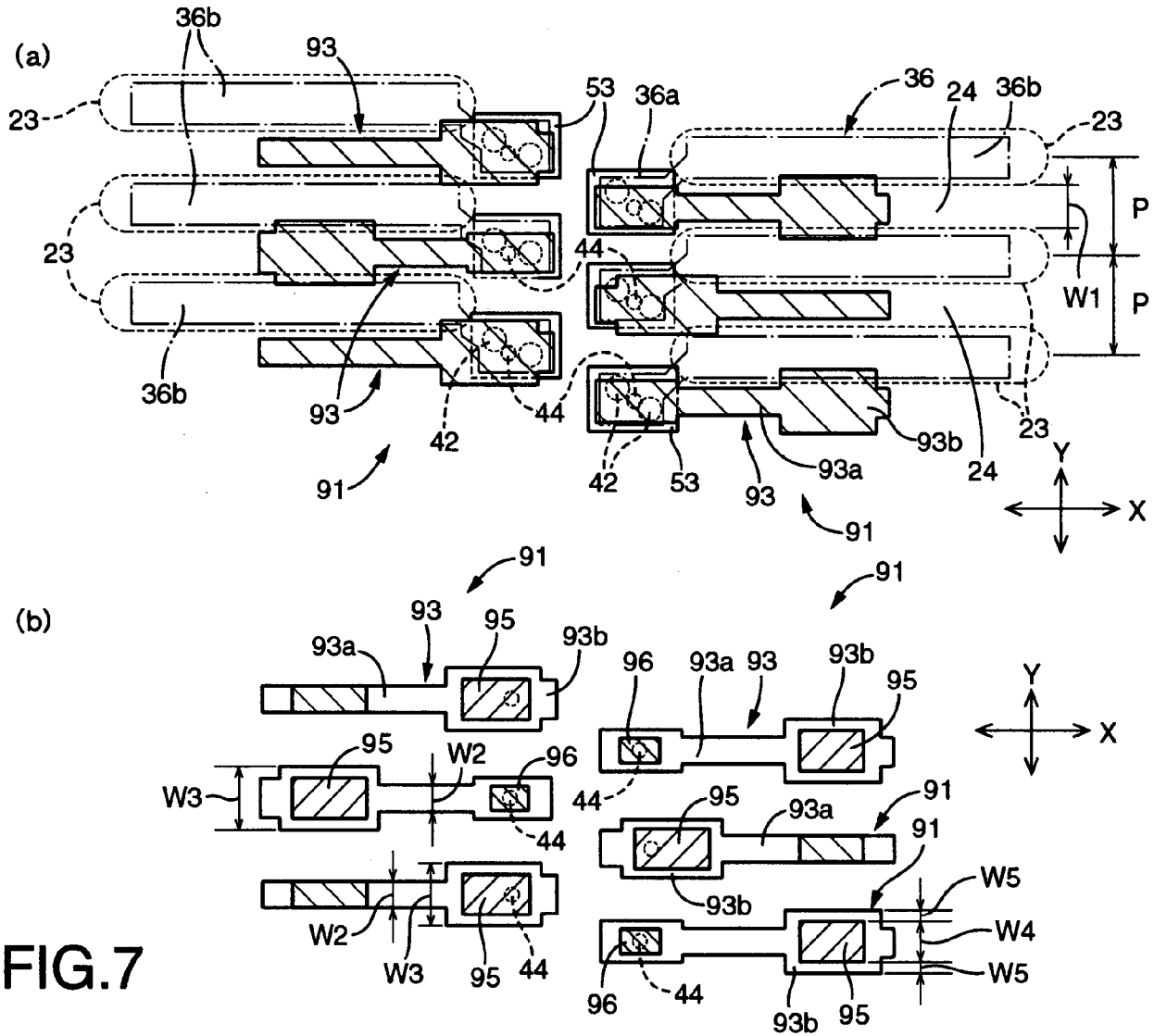
FIG. 7(*a*) is an enlarged top plan view partially illustrating pressure chambers, the individual electrodes, connection patterns, and the bonding terminations for individual connection, for explanation of the respective arrangements, and FIG. 7(*b*) is an enlarged top plan view illustrating surface electrodes and external electrodes which are disposed on the bonding terminations for individual connection, for explanation of an example of the arrangement thereof.

FIG. 7(*a*) illustrates partially the top sheet 35 in enlarged top plan view. In FIG. 7(*a*), the patterns of the individual electrodes 36 are depicted in dot-dash lines, while the pressure chambers 23 are depicted in broken lines.

The pattern of each individual electrode 36 includes a straight portion 36*b*, and an extension 36*a* extending outwardly of the straight portion 36*b* at one of its both ends. The straight portion 36*b* is generally equal in length to the corresponding pressure chamber 23, and is overlapped therewith in top plan view. The straight portion 36*b* extends straight with a slightly smaller width than the corresponding pressure chamber 23*a*.

As shown in FIG. 7(*a*), the extension 36*a* in each individual electrode 36 is formed so as to be at an angle to the straight portion 36*b* in top plan view, eventually to extend outwardly from the corresponding pressure chamber 23.

In particular, as shown in FIG. 4, for the third array of individual electrodes 36-3, the associated extensions 36*a* are alternate in the start position at which each extension 36*a* extends outwardly of the corresponding straight portion 36*b*, such that the start positions of the extensions 36*a* are changed between both ends of the straight portions 36*b*.

Further, as shown in FIG. 4, for the third array of individual electrodes 36-3, the associated extensions 36*a* are also alternate in the extension direction in which each extension 36*a* extends outwardly of the corresponding pressure chamber 23, such that the extension directions of the extensions 36*a* are changed between opposite directions in the Y-direction.

As shown in FIG. 4, each extension 36*a* is at least partially overlapped, in top plan view, with vertically adjacent two of the piezoelectric sheets 34 at their dummy individual electrodes 38 each functioning as a first land-shaped individual conductive area.

As shown in FIGS. 4, 7(*a*), 8(*a*), each extension 36*a* is at least partially overlapped, in top plan view, with connection patterns 53 of the sheet 46 forming the aforementioned constraint layer.

Figure 5:
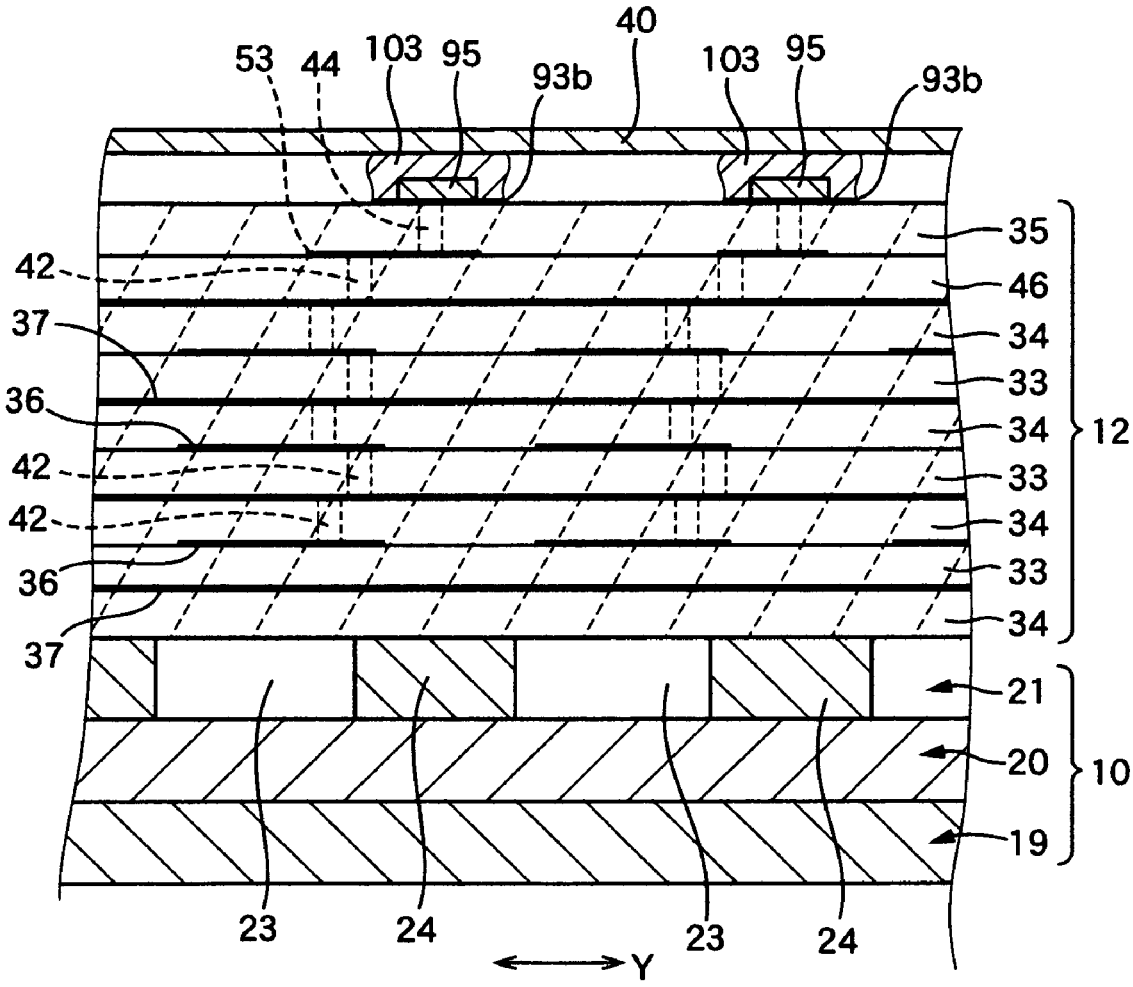
FIG. 5 is an enlarged cross section partially illustrating the flexible flat cable, the piezoelectric actuator, and the cavity unit, all of which are illustrated in FIG. 1, and additionally illustrating individual electrodes, dummy electrodes, and inner conductive electrodes for the individual and dummy electrodes, all of which are disposed in a plurality of piezoelectric sheets constructing the piezoelectric actuator, for explanation of an example of the arrangement thereof.
Figure 8:
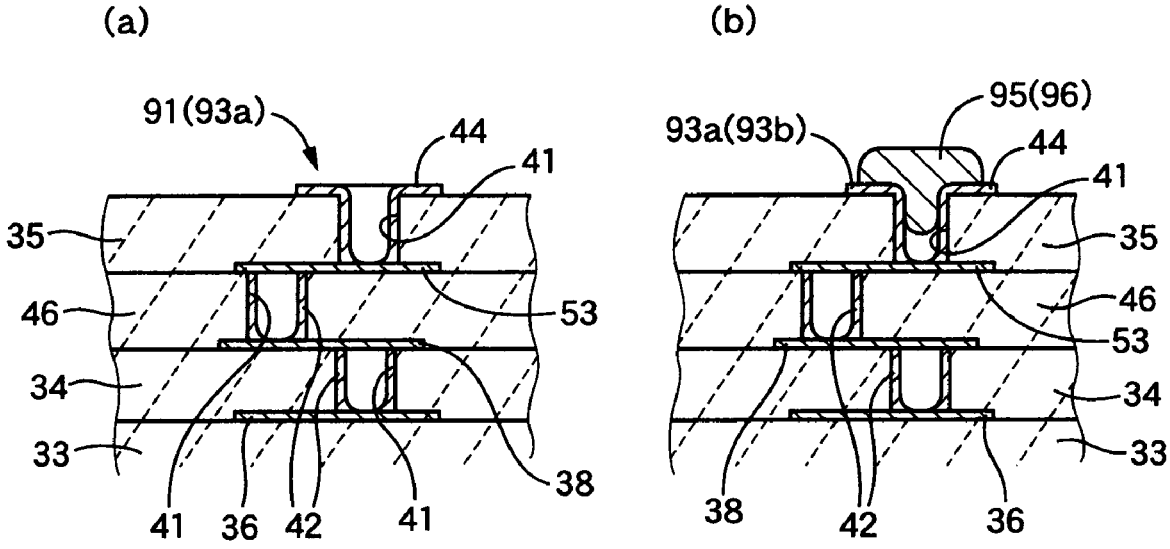
FIG. 8(*a*) is a cross section illustrating through holes in the top sheet illustrated in FIG. 6, with upper open ends thereof being open, and FIG. 8(*b*) is a cross section illustrating the through holes coated with the external electrodes each functioning as an external conductive area or a dummy portion.

As shown in FIGS. 5, 7, and 8(*a*), each extension 36*a* is at a position for allowing electrical connections with one of a plurality of inner conductive electrodes 42 which is within one of a plurality of through holes 41 piercing through each piezoelectric sheet 33; another inner conductive electrode 42 within another through hole 41 piercing through each piezoelectric sheet 34; and still another inner conductive electrode 42 within still another through hole 41 piercing through the sheet 46.

As shown in FIG. 4, a dummy common electrode 43 is formed on each piezoelectric sheet 33 in an area thereof which is partially overlapped, in top plan view, with the common electrode 37 of each piezoelectric sheet 34, and which includes a peripheral region along the short sides and the long sides of one of faces of each piezoelectric sheet 33 which has a large width, etc.

As shown in FIG. 4, each common electrode 37 is patterned using a screen printing technique at the piezoelectric sheets 34 (the odd-numbered ones of the plurality of alternately-laminated piezoelectric sheets 33 and 34, of course including the lowermost one of the piezoelectric sheets 34) on their surfaces (upper faces). One of the common electrodes 37 which corresponds to the lowermost piezoelectric sheet 34 is patterned throughout on the upper face of the instant piezoelectric sheet 34.

As shown in FIG. 4, for each one of the piezoelectric sheets 34 excluding the lowermost one of them, the corresponding common electrode 37 is overlapped in position, in top plan view, with the pressure-chamber-arrays 23-1 to 23-5, and the individual-electrode-arrays 36-1 to 36-5.

More specifically, as shown in FIG. 4, each common electrode 37 includes first conductive portions 37*a* each elongated along the long sides of each piezoelectric sheet 34 (in the Y-direction), and second conductive portions 37*b* which are each elongated in the short sides of each piezoelectric sheet 34 (in the X-direction), and which are connected with both ends of the first conductive portions 37*a*.

As shown in FIG. 4, each common electrode 37 is formed on each piezoelectric sheet 34 so as to surround a region of each piezoelectric sheet 34 in which arrays of land-shaped dummy individual electrodes 38 are formed on each piezoelectric sheet 34.

As shown in FIG. 4, each dummy individual electrode 38 is generally in the form of a rectangle in top plan view. The plurality of dummy individual electrodes 38 are patterned on each piezoelectric sheet 34 at equal intervals, such that each dummy individual electrode 38 is at least partially overlapped, in top plan view, not with the straight portion 36*b* but with the extension 36*a*, of the corresponding individual electrode 36.

As shown in FIG. 4, a plurality of connection patterns 53 each being generally in the form of a rectangle in top plan view are formed on the upper face of the sheet 46 of the aforementioned constraint layer, at equal intervals, such that each connection pattern 53 is at least partially overlapped, in top plan view, with each corresponding dummy individual electrode 38 in each piezoelectric sheet 34.

As shown in FIG. 4, a communication pattern 54, which functions as a common conductive area, are formed on the upper face of the sheet 46, in such as regions extending along the short sides of the sheet 46, so as to be overlapped in position, in top plan view, with a portion of each common electrode 37 of each piezoelectric sheet 34, and a portion of each dummy common electrode 43 of each piezoelectric sheet 33.

Aside from the lowermost piezoelectric sheet 34, all the piezoelectric sheets 33, 34 and the sheet 46 are processed for electrically and vertically interconnecting the common electrode 37 each including the conductive portions 37*a* and 37*b*, and the dummy common electrodes 43, at a plurality of locations.

For this connecting process, such as shown in FIG. 5, a plurality of through holes 41 pierce through each piezoelectric sheet 33, 34 thickness-wise at positions of each common electrode 37 and each dummy common electrode 43. As shown in FIG. 8, the through holes 41 are filled respectively with a conductive material (e.g., conductive paste), thereby forming the inner conductive electrodes 42 within the respective through holes 41.

Similarly, the extensions 36*a* of the individual electrodes 36 of the piezoelectric sheets 33, the dummy individual electrodes 38 of the piezoelectric sheets 34, and the communication pattern 54 of the sheet 46 are processed to be electrically and vertically interconnected.

For this connecting process, as shown in FIG. 5, a plurality of through holes 41 pierce through each piezoelectric sheet 33, 34, 46 thickness-wise at positions of each common electrode 37 and each dummy common electrode 43. As shown in FIG. 8, the through holes 41 are filled respectively with a conductive material (e.g., conductive paste), thereby forming the inner conductive electrodes 42 within the respective through holes 41.

Figure 6:
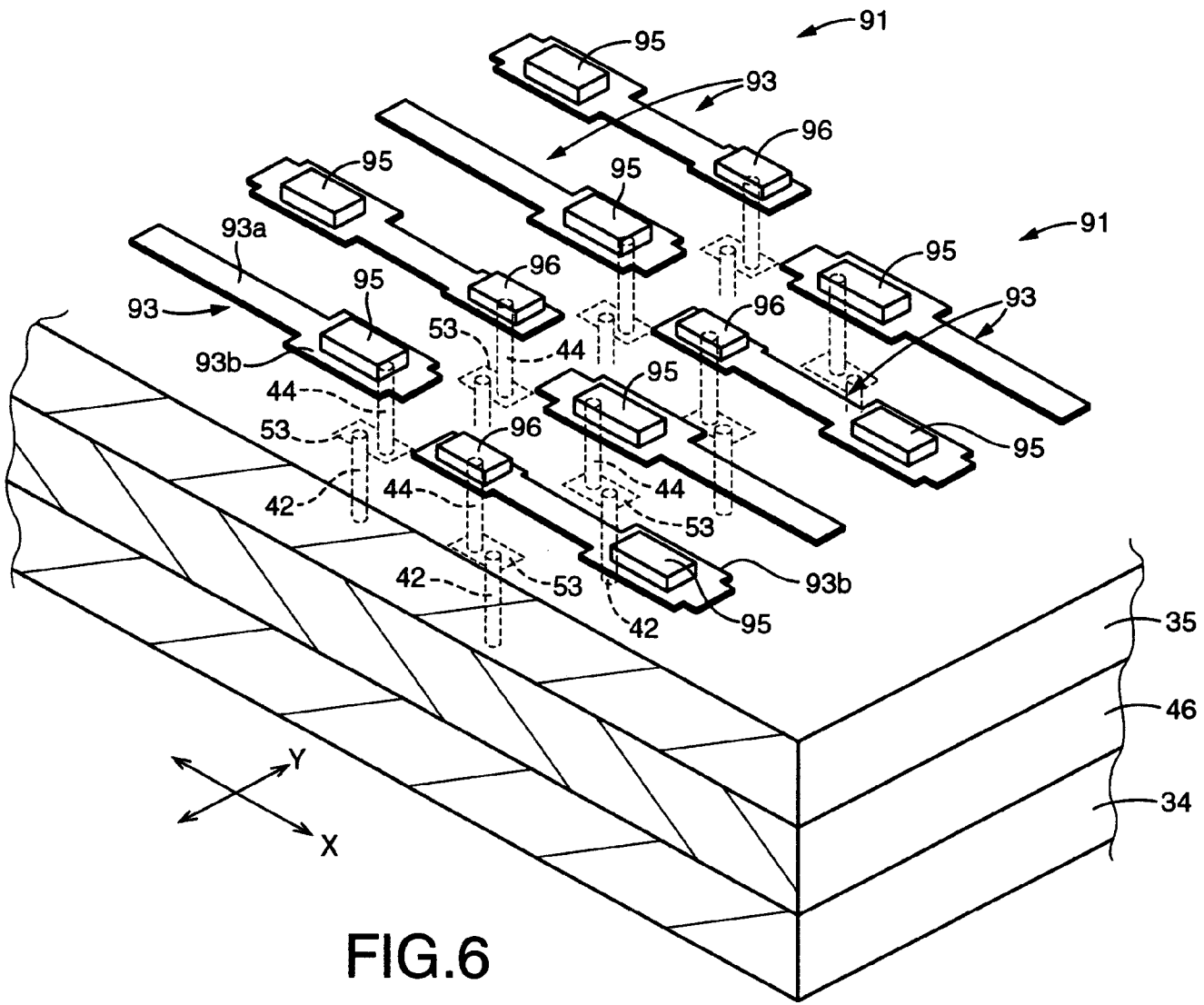
FIG. 6 is an enlarged perspective view partially illustrating a top sheet illustrated in FIG. 4, for explanation of an example of the arrangement of a plurality of bonding terminations, etc. formed on the surface of the top sheet.

As shown in FIGS. 6, 7(*a*), and 8(*a*), the inner conductive electrodes 42 formed in the piezoelectric sheets 33, 34, 46 arranged vertically are disposed to be so spaced apart that the inner conductive electrodes 42 are not overlapped, in top plan view, with each other.

Figure 9:
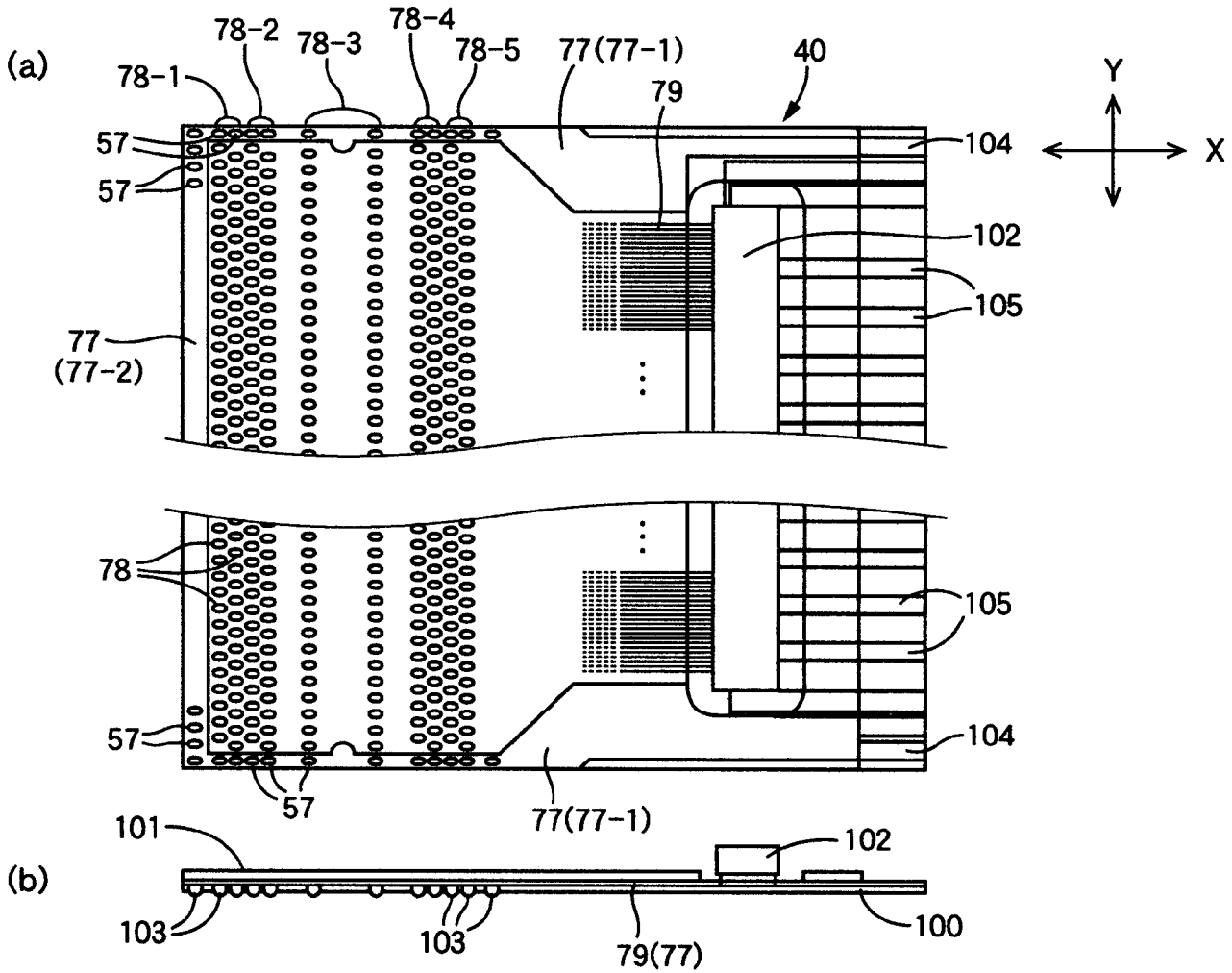
FIG. 9(*a*) is an enlarged top plan view partially illustrating the flexible flat cable illustrated in FIG. 1, for explanation of an example of the arrangement of the bonding terminations for common connection, the bonding terminations for individual connection, a wiring, and an IC (integrated circuit), etc. in the flexible flat cable, and FIG. 9(*b*) is a side view illustrating the flexible flat cable.

As shown in FIGS. 4, 7(*a*) and (*b*), and 8(*a*), on the upper face (surface) of the top sheet 35, which is the uppermost sheet (surface sheet) of the piezoelectric actuator 12, there are formed a plurality of land-shaped bonding terminations (bonding electrodes) 90 for common connection, and a plurality of land-shaped bonding terminations (bonding electrodes) 91 for individual connection. The bonding terminations 90 and 91 are to be bonded to the lower face of the flexible flat cable 40 at a plurality of bump electrodes 103 for common connection and a plurality of bump electrodes 103 for individual connection, as shown in FIG. 9.

As shown in FIG. 4, each bonding termination 90 includes a surface electrode 92 formed on the surface of the top sheet 35, with a small layer-thickness, and an external electrode 94 as an external conductive area with a large layer-thickness. On the other hand, as shown in FIGS. 4-7, each bonding termination 91 includes a surface electrode 93 formed on the surface of the top sheet 35, with a small layer-thickness, and an external electrode 95 as an external conductive area with a large layer-thickness.

As shown in FIGS. 5 and 6, the external electrode 95 of each bonding termination 91 is formed on the surface of the corresponding surface electrode 93, and the external electrode 94 of each bonding termination 90 is similarly formed on the surface of the corresponding surface electrode 92, as not shown.

Such as shown in FIGS. 5-8, a plurality of through holes 41 pierce through the top sheet 35 thickness-wise, for vertical and electrical interconnection between the bonding terminations 90 and 91 of the top sheet 35, and the communication pattern 54 and the connection patterns 53 of the sheet 46. The through holes 41 are filled respectively with a conductive material (e.g., conductive paste), thereby forming inner conductive electrodes 44 within the respective through holes 41, in the same manner described above.

Each surface electrode 92, 93 is formed by a screen printing technique on the surface of a so-called green sheet which is the original of each one of the piezoelectric sheets 33 and 34 and the top sheet 35, using an Ag—Pd-based conductive material. This material is conductive paste, similar to a material for use in forming the individual electrodes 36, the common electrodes 37, the dummy individual electrodes 38, the dummy common electrodes 43, the inner conductive electrodes 42 and 44 filling the through holes 41, the connection pattern 53, and the communication pattern 54.

Thereafter, the piezoelectric sheets 33, 34 and the top sheet 35 are laminated in a given order, pressed, and fired, resulting in the formation of the laminate of the piezoelectric sheets 33, 34 and the top sheet 35.

It is added that, prior to the patterning process by the aforementioned screen printing technique, the plurality of through holes 41 are formed on the piezoelectric sheets 33, 34 and the top sheet 35 by piercing them. The fill and formation of the inner conductive electrodes 42 and 44 within the respective through holes 41 are performed during the patterning process.

As a result of the firing process of the laminate, as shown in FIG. 8(*a*), each inner conductive electrode 42, 44 within each through hole 41 is shrunk and tubularly affixed to an inner tubular wall face of each through hole 41.

In particular, for ones of the through holes 41 which correspond to the bonding terminations 90 (the surface electrodes 92) for common connection and the bonding terminations 91 (the surface electrodes 93) for individual connection both formed on the surface (upper face) of the top sheet 35, each inner conductive electrode 44 within each through hole 41 is formed generally as an annular ring having a very small width (corresponding to a thickness of approximately 1 μm after the firing process, for example), in top plan view.

In light of this, in the present embodiment, as shown in FIG. 8(*b*), each through hole 41 is widely coated at its open end, with a corresponding one of the external electrodes 94 and 95 (and dummy portions 96 described later with reference to FIG. 7) each functioning as an external conductive area having a large thickness (a thickness of approximately 10 μm after the firing process, for example). Accordingly, the inner conductive electrodes 44 tightly attached to the inner wall faces of the through holes 41 are electrically and widely coupled with the external electrodes 94 and 95.

As a result, the inner conductive electrodes 44 are not required to be exposed, and therefore, undesired electrical disconnection is prevented from occurring between the inner conductive electrodes 44 and the surface electrodes 92 and 93, even though the surface of the top sheet 35 is rubbed with such as a jig during handling.

Further, as shown in FIG. 8(*b*), the external electrodes 94 and 95 (and the dummy portions 96) each functioning as the external conductive area are formed so as to be inserted into the inner space of the through holes 41 and so as to be tightly attached to the inner conductive electrodes 44 at the open ends of the through holes 41. In the present embodiment, the hollow-shaped inner conductive electrodes 44 are coated and plugged with the external electrodes 94 and 95 at the open ends of the through holes 41.

Therefore, the present embodiment allows the external electrodes 94 and 95 to reinforce the inner conductive electrodes 44 at its very thin portion, thereby preventing undesired electrical disconnection from occurring between the inner conductive electrodes 44 and the external electrodes 94 and 95, in a more secured manner.

As shown in FIG. 8(*b*), in the present embodiment, the through holes 41 formed in the sheet 46 are disposed out of phase or non-coincident with the through holes 41 formed in the top sheet 35. Therefore, portions of the top sheet 35 at which the through holes 41 are present are supported thickness wise by portions of the sheet 46 at which the through holes 41 are absent, which portions are more rigid than portions of the sheet 46 at which the through holes 41 are present.

As a result, undesired deformation of the flexible flat cable 40 is prevented from being caused due to pressing of bonding electrodes 77 and 78 of the flexible flat cable 40 (described later with reference to FIG. 9) onto the external electrodes 94 and 95 formed on the top sheet 35 so as to overlay or cover the through holes 41 at their open ends.

It is added that the external electrodes 94 and 95 each as the external conductive area and the dummy portions 96 are formed on the surface of the top sheet 35 by a printing technique using Ag-glass-frit-based conductive paste for thick film (the same as that of the common electrodes 37 and the individual electrodes 36) after firing the surface electrodes 92 and 93 at a given firing temperature.

Thereafter, the external electrodes 94 and 95 and the dummy portions 96 are fired at a temperature lower than the given firing temperature, resulting in completion of the external electrodes 94 and 95 and the dummy portions 96.

It is further added that an Ag-glass-frit-based conductive material is low in fusing temperature but is good in easiness-to-be-bonded to solder alloy, as compared with an Ag—Pd-based conductive material. For the bonding terminations 90 and 91, the external electrodes 94 and 95 are formed using an Ag-glass-frit-based conductive material, on the surfaces of the surface electrodes 92 and 93 formed using an Ag—Pd-based conductive material.

Therefore, the present embodiment allows the bonding terminations 90 and 91 to be easily joined with the bump electrodes 103 (see FIG. 9(*b*)) of the flexible flat cable 40, as compared with when the joining is performed without intervention of the external electrode 94 or 95.

Next, the construction of the bonding terminations (bonding electrodes) 91 for individual connection will be described in further detail.

As shown in FIG. 6, each bonding termination 91 includes the corresponding surface electrode 93 and the corresponding external electrode 95, as described above. As shown in FIGS. 6, 7(*a*), and 7(*b*), the plurality of surface electrodes 93 each having a small layer (film) thickness, are formed on the upper face of the top sheet 35, such that each surface electrode 93 is at least partially overlapped, in top plan view, with each corresponding one of the connection patterns 53 formed on the sheet 46, and such that the surface electrodes 93 are arranged at equal intervals.

As shown in FIG. 6, each surface electrode 93 is generally in parallel to the shorter sides (in the second direction or the X-direction) of the top sheet 35, and also to the straight portion 36*b* of each corresponding one of the individual electrodes 36. Besides, as shown in FIG. 7(*a*), each surface electrode 93 is disposed above each corresponding one of the division walls 24 located between adjacent twos of the pressure chambers 23, 23 in the base plate 21 located below each surface electrode 93.

Therefore, as shown in FIG. 6, the surface electrodes 93 are arranged with the same pitch as the pitch P with which the pressure chambers 23 are arranged in the first direction (the Y-direction), on a per array basis, and are disposed out of phase or non-coincident with the pressure chambers 23 by a half of the chamber-to-chamber pitch P.

As shown in FIGS. 7(*a*) and 7(*b*), a most part of each surface electrode 93 is assigned a narrow portion 93*a* having a smaller width W2 than a width W1 (W1<W2) of each division wall 24. A wide portion 93*b* is formed so as to be continuously linked with the narrow portion 93*a*. The wide portion 93*b* has a width W3 which is set slightly larger than the width W1 of each division wall 24.

In the present embodiment, various dimensions are set for example as follows:

- the pitch P (chamber-to-chamber pitch) of the pressure chambers 23 arranged in the first direction=approximately 0.339 μm;
- the width W1 of each division wall 24=approximately 120 μm –approximately 150 μm;
- the width W2 of the narrow portion 93*a* of each surface electrode 93=approximately 100 μm; and
- the width W3 of the wide portion 93*b* of each surface electrode 93=approximately 150 μm–approximately 300 μm.

It is preferable that the width W3 is set to be approximately 200 μm–approximately 220 μm.

In addition, in the present embodiment, other various dimensions are set for example as follows:

- a length L3 of the wide portion 93*b* of each surface electrode 93=approximately 360 μm; and
- a layer thickness t of each surface electrode 93=approximately 1 μm–approximately 2 μm.

As shown in FIG. 7(*b*), each external electrode 95 later attached to the surface of the wide portion 93*b* is smaller in area than the corresponding wide portion 93*b*, in top plan view. Further, each external electrode 95 is disposed such that its circumferential edge is located within that of the corresponding wide portion 93*b*.

In the present embodiment, it is preferable that a width W4 of each external electrode 95 is set to approximately 150 μm–approximately 200 μm, and a spacing W5 between the circumferential edge of each external electrode 95 and the circumferential edge of the corresponding wide portion 93*b* is set to approximately 25 μm, in top plan view, and in the width direction. Each external electrode 95 has a layer thickness of 10 μm-20 μm.

As shown in FIG. 6, the bonding terminations 91 for individual connection are exposed to the outside, at portions of the bonding terminations 91 at which the surface electrodes 93 are connected with the inner conductive electrodes 44 piercing through the top sheet 35 thickness wise, so as to be locally assigned to the upper face of the piezoelectric actuator 12.

In the present embodiment, the inner conductive electrodes 44, in addition to the through holes 41, are filled at their upper portions with the same material as that of the external electrodes 95, so as to form a layer having a large thickness (a thickness of approximately 10 μm after the firing process, for example). As shown in FIGS. 6, 7(*b*), and 8(*b*), this provides the dummy portions 96 for the inner conductive electrodes 44. As a result, a connection between each inner conductive electrode 44 and the corresponding surface electrode 93 is protected from damage, etc.

Next, the construction of the bonding terminations (bonding electrodes) 90 for common connection will be described in greater detail.

As shown in FIG. 4, the surface electrodes 92, which are thinner than the external electrodes 94, and which are formed in the bonding terminations 90 for common connection, are disposed so as to be at least partially overlapped, in top plan view, with the communication pattern 54 on the sheet 46.

As shown in FIG. 4, the surface electrodes 92, each being shaped as a band or the like, are formed on the upper face of the top sheet 35 in the proximity to its outer circumferential edges. The external electrodes 94, which are thicker than the surface electrodes 92, are formed on the surface electrodes 92 in a desired shape.

As shown in FIG. 4, the bonding terminations 90 for common connection are exposed to the outside, at portions of the bonding terminations 90 at which the surface electrodes 92 are connected with the inner conductive electrodes 44 piercing through the top sheet 35 thickness wise, so as to be locally assigned to the upper face of the piezoelectric actuator 12.

As described above, in the present embodiment, the inner conductive electrodes 44, in addition to the through holes 41, are filled at their upper portions with the same material as that of the external electrodes 95, so as to form a layer having a large thickness (a thickness of approximately 10 μm after the firing process, for example). This provides the external electrodes 94 for the inner conductive electrodes 44. As a result, a connection between each inner conductive electrode 44 and the corresponding surface electrode 92 is protected from damage, etc.

As shown in FIGS. 6, 7(*a*), and 7(*b*), in the present embodiment, the plurality of arrays of the pressure chambers 23 are staggered, in top plan view, in a direction in which each array extends (the Y-direction), by a half of the chamber-to-chamber pitch, resulting in a staggered arrangement.

The positions of the extensions 36*a* of the individual electrodes 36 correspond to the positions of the pressure chambers 23 in a staggered arrangement. These extensions 36*a* are disposed, in top plan view, out of phase or non-coincident with the pressure chambers 23, by a half of the chamber-to-chamber pitch, in a staggered arrangement. In the same manner, the dummy individual electrodes 38 and the connection patterns 53 are disposed.

More specifically, as shown in FIG. 7(*a*), the extensions 36*a* are disposed adjacent to each other within areas between adjacent twos of the arrays of the pressure chambers 23, in top plan view. In the same manner, the dummy individual electrodes 38 and the connection patterns 53 are disposed.

Further, as shown in FIG. 7(*a*), the extensions 36*a* are disposed in phase or coincident, when viewed in the first direction (the Y-direction), with areas between adjacent twos of the pressure chambers 23 arranged in the same array extending in the first direction (the Y-direction), in top plan view. In the same manner, the dummy individual electrodes 38 and the connection patterns 53 are disposed.

Therefore, as shown in FIGS. 6, 7(*a*), and 7(*b*), in the present embodiment, the positions of the though holes 41 (the positions of the inner conductive electrodes 44) each piercing through the top sheet 35 perpendicularly to the surface thereof, correspond to the positions of the pressure chambers 23 in a staggered arrangement, and the through holes 41 are disposed, in top plan view, out of phase or non-coincident with the pressure chambers 23, by a half of the chamber-to-chamber pitch, in a staggered arrangement. In the same manner, positions at which the surface electrodes 93 of the bonding terminations 91 are connected with the inner conductive electrodes 44 are disposed.

More specifically, as shown in FIG. 7(*a*), the through holes 41 (corresponding to the inner conductive electrodes 44) are disposed adjacent to each other within areas between adjacent twos of the arrays of the pressure chambers 23, in top plan view. In the same manner, the positions at which the surface electrodes 93 are connected with the inner conductive electrodes 44 are disposed.

Further, as shown in FIG. 7(*a*), the through holes 41 (corresponding to the inner conductive electrodes 44) are disposed in phase or coincident, when viewed in the first direction (the Y-direction), with areas between adjacent twos of the pressure chambers 23 arranged in the same array extending in the first direction (the Y-direction), in top plan view. In the same manner, the positions at which the surface electrodes 93 are connected with the inner conductive electrodes 44 are disposed.

As shown in FIGS. 7(*a*) and (*b*), the surface electrodes 93 are generally formed so as to extend in the second direction (the X-direction) and are disposed so as to correspond, in top plan view, to positions (above the division walls 24) between adjacent twos of the pressure chambers 23 arranged in the same array extending in the first direction (the Y-direction).

As shown in FIG. 6, each external electrode 95 and each dummy portion 96 are formed respectively within the region of the corresponding surface electrode 93, as viewed in both the X- and Y-directions.

As shown in FIGS. 6 and 7(*b*), in the present embodiment, the bonding terminations 91 are arranged in the Y-direction, such that a portion of each bonding termination 91 at which the corresponding external electrode 95 is disposed is alternate in position between both end sides of each bonding termination 91.

Therefore, the present embodiment allows the area size of each external electrode 95 to be easily increased while securing an adequately large distance between adjacent two external electrodes 95 when viewed in both X- and Y-directions, as compared with an alternative example where the bonding terminations 91 are arranged in the Y-direction, such that the respectively corresponding external electrodes 95 are arranged in the Y-direction on the same end side of each bonding termination 91.

Next, the construction of the flexible flat cable 40 in the present embodiment will be described with respect to its electrical connection with the piezoelectric actuator 12 in the present embodiment, by referring to FIGS. 1, 9(*a*), 9(*b*), and 10.

Figure 10:
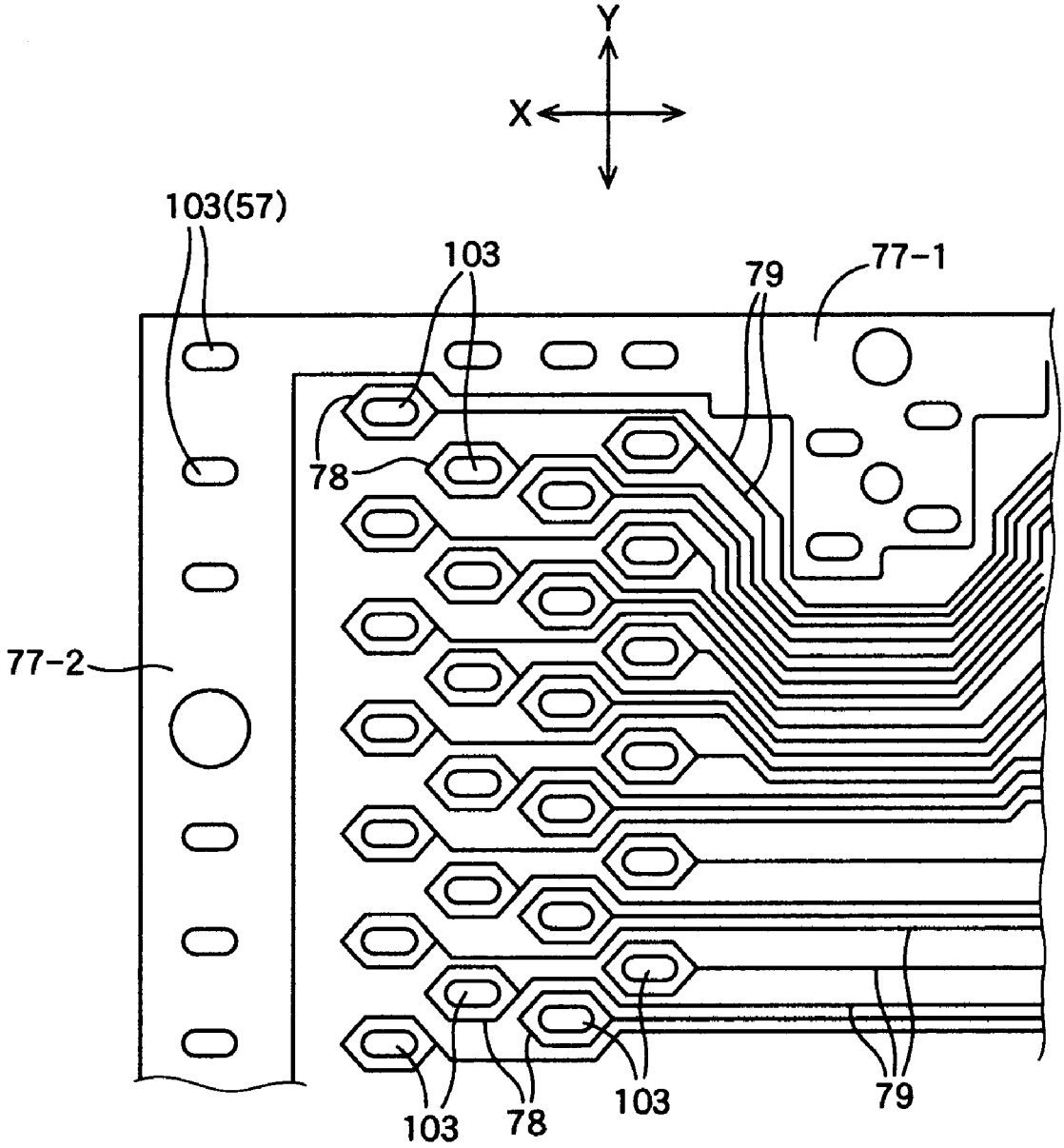
FIG. 10 is an enlarged top plan view partially illustrating the bonding terminations for common connection, the bonding terminations for individual connections, and the wiring in the flexible flat cable illustrated in FIG. 9.

FIG. 9(*a*) is a top plan view partially showing the flexible flat cable 40, FIG. 9(*b*) is a side view showing the flexible flat cable 40, and FIG. 10 is a top plan view partially showing the flexible flat cable 40 in enlargement.

The flexible flat cable 40 includes a plurality of bonding electrodes 77 for common connection and a plurality of bonding electrodes 78 for individual connection which are electrically connected with the piezoelectric actuator 12 at the plurality of bonding terminations 90 for common connection and the plurality of bonding terminations 91 for individual connection, respectively, both formed on the surface of the piezoelectric actuator 12. The flexible flat cable 40 further includes a wiring 79 allowing these bonding electrodes 77 and 78 to be connected with external elements (not shown).

As shown in FIG. 1, the flexible flat cable 40 is disposed on the upper face of the top sheet 35, for use with the piezoelectric actuator 12, such that the flexible flat cable 40 protrudes outwardly and perpendicularly to each nozzle array N (in the X-direction), and such that the flexible flat cable 40 is superposed on the upper face of the top sheet 35 at one of both ends of the top sheet 35, wherein the both ends are spaced apart in the longitudinal direction of the piezoelectric actuator 12.

For the manufacturing process and the structure of the flexible flat cable 40, as shown in FIG. 9(*b*), the flexible flat cable 40 is formed by coating a base material 100 having desired elements formed on a single side thereof, with a cover-lay 101.

More specifically, the base material 100 is a band-shaped material made up of a flexible synthetic resin (e.g., a polyimide resin, a polyester resin, or a polyamide resin). On a single side of the base material 100, the bonding electrodes 77 for common connection and the bonding electrodes 78 for individual connection which are made up of a cupper foil, and the wiring 79 fine-structured are formed by a photo-resist method, etc.

As shown in FIG. 9(*b*), the surfaces of the bonding electrodes 77, 78 and the wiring 79 are coated with the cover-lay 101 made up of a flexible synthetic resin (e.g., a polyimide resin, a polyester resin, or a polyamide resin).

As shown in FIGS. 9(*a*) and (*b*), the wiring 79 is electrically coupled at its one side with the bonding electrodes 77 for common connection and the bonding electrodes 78 for individual connection, while the same wiring 79 is electrically coupled at its opposite side with an IC (Integrated Circuit) 102 for drive mounted on the base material 100. More specifically, the flexible flat cable 40 is electrically coupled at one of its longitudinally spaced-apart both ends with the piezoelectric actuator 12, and is provided at the opposite end with a plurality of terminations 105 with which the IC 102 is electrically coupled.

As shown in FIG. 9(*a*), the positions at which the plurality of land-shaped bonding electrodes 78 for individual connection are formed within the region of the base material 100 are determined so as to face the positions of the external electrodes 95 of the plurality of land-shaped bonding terminations 91 formed in the top sheet 35, respectively. The base material 100 is pierced at each one of the facing positions to form each corresponding hole (aperture), and, as shown in FIG. 9(*b*), each bump electrode 103 made up of a solder alloy is rigidly attached to each corresponding hole (aperture) stated above.

Similarly, the base material 100 is pierced within the region of the band-shaped bonding electrode 77 (a first and second common bonding electrode area 77-1 and 77-2 described later) for common connection formed in the base material 100, at positions facing the positions of the external electrodes 94 of the plurality of land-shaped bonding terminations 90 formed in the top sheet 35, respectively. Each bump electrode 103 is rigidly attached to each corresponding hole (aperture) stated above.

As shown in FIG. 9(*a*), the common electrode 77 includes at least two band-shaped first common bonding electrode areas 77-1 and 77-1 which are formed in the flexible flat cable 40 along paired side edges thereof coextending in the second direction (the X-direction or the width direction of the piezoelectric actuator 12).

In the present embodiment, the common bonding electrode 77 further includes a single band-shaped second common bonding electrode area 77-2 which is formed in the flexible flat cable 40 along one of paired side edges thereof coextending in the first direction (the Y-direction or the longitudinal direction of the piezoelectric actuator 12).

The second common bonding electrode area 77-2 is electrically coupled at it both ends with the two first common bonding electrode areas 77-1 and 77-1 at their one ends, respectively. These two first common bonding electrode areas 77-1 and 77-1 are electrically coupled at their another ends with a plurality of connecting terminations 104, respectively. The connecting terminations 104 are disposed in the flexible flat cable 40 at the same one of its longitudinally spaced-apart both ends that the terminations 105 are disposed at.

Although the construction of the bonding electrode 77 has been described above, the plurality of bonding electrodes 78 for individual connection extend in the first direction (the Y-direction) so as to oppose the first, second, third, fourth, and fifth pressure-chamber-arrays 23-1, 23-2, 23-3, 23-4, and 23-5 and the plurality of arrays of the external electrodes 95 corresponding in position to these pressure-chamber arrays, and these bonding electrodes 78 are in a staggered arrangement.

More specifically, as shown in FIG. 9(*a*), these bonding electrodes 78 are comprised of a first individual bonding electrode array 78-1 corresponding to the first pressure-chamber-array 23-1; a second individual bonding electrode array 78-2 corresponding to the second pressure-chamber-array 23-2; a third individual bonding electrode array 78-3 corresponding to the third pressure-chamber-array 23-3; a fourth individual bonding electrode array 78-4 corresponding to the fourth pressure-chamber-array 23-4; and a fifth individual bonding electrode array 78-5 corresponding to the fifth pressure-chamber-array 23-5.

The wiring 79 is formed in a pattern in which the wiring 79 extends in the second direction (the X-direction), with the wiring 79 being connected with the individual bonding electrodes 78 in all the arrays. As shown in FIG. 10, each electrical line of the wiring 79 is formed such that, after extending outwardly from the corresponding one of the individual bonding electrodes 78, each electrical line is bent to the Y-direction, where appropriate, so as to pass through a clearance between adjacent two of the remainder of the individual bonding electrodes 78.

As shown in FIGS. 9(*a*) and (*b*), the IC 102 for drive is adapted to convert print data received in series from an external device (a control board located on the side of the body of the aforementioned image forming apparatus) into parallel data associated with each nozzle 11*a*. The IC 102 is further adapted to produce a wave signal representative of a voltage corresponding to the received print data, based on the parallel data, and to output the wave signal to a corresponding one of the electrical lines of the wiring 79.

Because the wiring 79 located between the IC 102 and the piezoelectric actuator 12 requires the number of its lines to correspond to that of the nozzles 11*a*, the wiring pattern of these lines are required to have an increased line density. However, the print data is communicated between the IC 102 and the aforementioned control board in series. Therefore, the present embodiment more easily allows the requirements of the line density of the wiring 79 to be relaxed.

For bonding the flexible flat cable 40 at its bump electrodes 103 made up of solder alloy to the piezoelectric actuator 12, the bump electrodes 103 are heat-pressed onto the external electrodes 94 of the bonding terminations 90 for common connection and the external electrodes 95 of the bonding terminations 91 for individual connection both located in the top sheet 35, in superposed relationship thereon.

Figure 11:
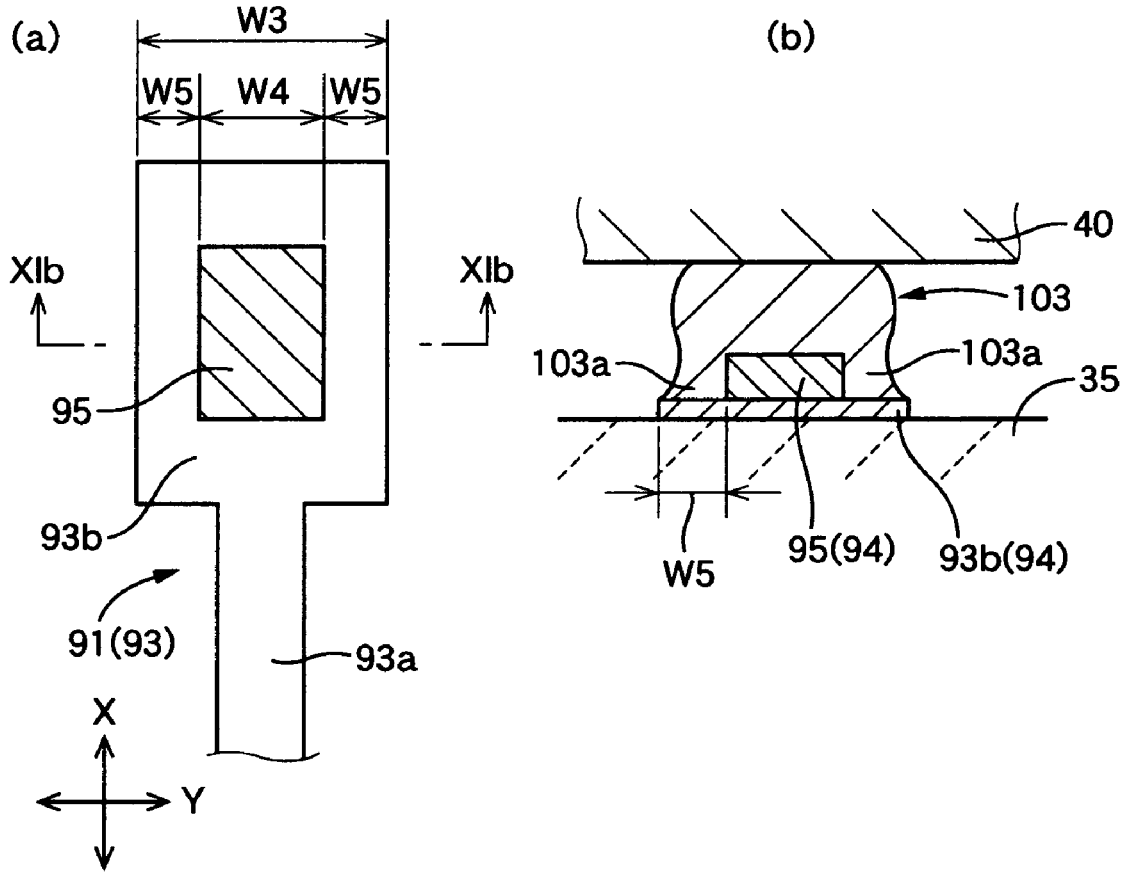
FIG. 11(*a*) is an enlarged top plan view partially illustrating the surface electrode and the external electrode of a representative one of the bonding terminations for individual connection illustrated in FIG. 6, and FIG. 11(*b*) is a cross section of the representative bonding termination, which is an enlarged view taken on line XIb-XIb in FIG. 11(*a*), for explanation of how these surface electrode and external electrode are bonded to the flexible flat cable via bump electrodes.

With the heat-press, as shown in FIG. 11(*b*), solder alloy into which each bump electrode 103 has been fused overlays or covers the corresponding external electrode 95 at its upper and side faces, and further overlays or covers the corresponding surface electrode 93 at its periphery near around the corresponding wide portion 93*b*.

The surface of each wide portion 93*b* (surface electrode 93) made up of Ag—Pd-based conductive paste is good in the wettability with fused solder alloy, and achieves eutectic bonding with the corresponding external electrode 95 made up of Ag-glass-frit-based conductive paste and with solder alloy, resulting in enhanced bonding strength therebetween.

As shown in FIGS. 11(*a*) and (*b*), an increase in the spacing W5 between the side edge (circumferential edge) of each external electrode 95 and the side edge (circumferential edge) of the corresponding wide portion 93*b*, when viewed in cross section, causes an increase in the thickness of a fillet 103*a* (see FIG. 11(*b*)) formed between the side face of the external electrode 95 and the surface of the wide portion 93*b*.

On the other hand, repetitive use of the flexible flat cable 40 in a widely-fluctuated temperature environment causes large expansion or contraction of the flexible flat cable 40, resulting in an increase or decrease in the distances between the bump electrodes 103.

The increase or decrease in the distances between the bump electrodes 103 induces stress concentration at the fillet 103*a* located between each bump electrode 103 and the corresponding external electrode 95 bonded thereto. The larger the stress concentration factor (shape factor) defined in the field of the strength of materials, the larger the stress concentration. Further, the smaller the radius of curvature of the sectional profile of the fillet 103*a*, the larger the stress concentration.

The present embodiment allows an easier increase in the thickness of the fillet 103 for increasing the radius of curvature of the sectional shape of the fillet 103*a*. Therefore, the stress concentration factor of the fillet 103*a* can be more easily reduced for a relaxation of the stress concentration. Accordingly, the present embodiment suppresses occurrence of crack and electrical disconnection in the fillet 103*a* due to application of thermal shock or repeated load (causing fatigue), if any.

The stress concentration occurring in the fillet 103*a* is emphasized, upon contraction of the flexible flat cable 40 in its width direction (the first direction or the Y-direction).

On the other hand, enhancement in the durability of the bump electrodes 103 requires an increase in the thickness of the fillet 103*a* located between one of the side edges of each land-shaped external electrode 95 which extends in the X-direction orthogonal to the Y-direction, and the surface of the corresponding wide portion 93*b*.

For fulfilling this requirement, the width W4 of each external electrode 95 is preferably reduced as much as possible, relative to the width W3 of each wide portion 93*b* measured in the X-direction, thereby increasing the width W5 of each wide portion 93*b* which is assigned to a base platform (base area) on which the corresponding fillets 103*a* are formed.

In the embodiment, as shown in FIG. 7(*a*), the bonding terminations 91 for individual connection (including the surface electrodes 93 and the external electrodes 95) are disposed such that each bonding termination 91 is in phase or coincident in position with an area located between adjacent two of the pressure chambers 23 in the cavity unit 10, namely, each division wall 24, in top plan view.

Therefore, the present embodiment, upon pressing the flexible flat cable 40 onto the piezoelectric actuator 12 in alignment between the bump electrodes 103 and the external electrodes 95, allows the pressing force acting therebetween to be born by each division wall 24. As a result, each hollow pressure chamber 23 is prevented from being unexpectedly deformed due to the pressing of the bump electrodes 103 onto the external electrodes 95.

In the present embodiment, the plurality of external electrodes 95 for individual connection are in a staggered arrangement in top plan view, and also, the plurality of corresponding bump electrodes 103 (the bonding electrodes 78 for individual connection) are in a staggered arrangement in top plan view. Therefore, the distances between adjacent twos of the plurality of external electrodes 95 can be more easily increased, and this applies to the bump electrodes 103.

Further, the lines of the wiring 79 can be more easily disposed, such that the lines pass through widened clearances between adjacent twos of the bump electrodes 103 in a manner that adjacent twos of the lines are as much spaced as possible.

Therefore, the present embodiment allows an easier reduction in mutual inductance between the lines of the wiring 79.

Further, in the present embodiment, the staggered arrangement of the external electrodes 95 allows an easier achievement of a desired increase in the area size of each external electrode 95. Therefore, somewhat misalignment, if any, of the external electrodes 95 and the bump electrodes 103 of the flexible flat cable 40 in superposed relationship on each other does not adversely affect electrical connection therebetween.

It is added that the external electrodes 95 and the dummy portions 96 may be formed concurrently by a single process, because of both being made up of conductive paste.

Next, a second embodiment of the present invention will be described. However, the present embodiment is partially common in construction to the first embodiment, and therefore, the common elements of the present embodiment will be referenced the same reference numerals or names as those in the description and illustration of the first embodiment, without a redundant description and illustration, while only the distinctive elements in the present embodiment will be described below in more detail with reference to FIGS. 12-14.

In the first embodiment, as shown in FIG. 2, the plurality of nozzles 11*a* are arranged in five coextending arrays, and each of the plurality of boding terminations 91 for individual connection and the plurality of bonding electrodes 78 for individual connection are arranged in ten coextending arrays in a staggered arrangement, as shown in FIG. 9.

Figure 12:
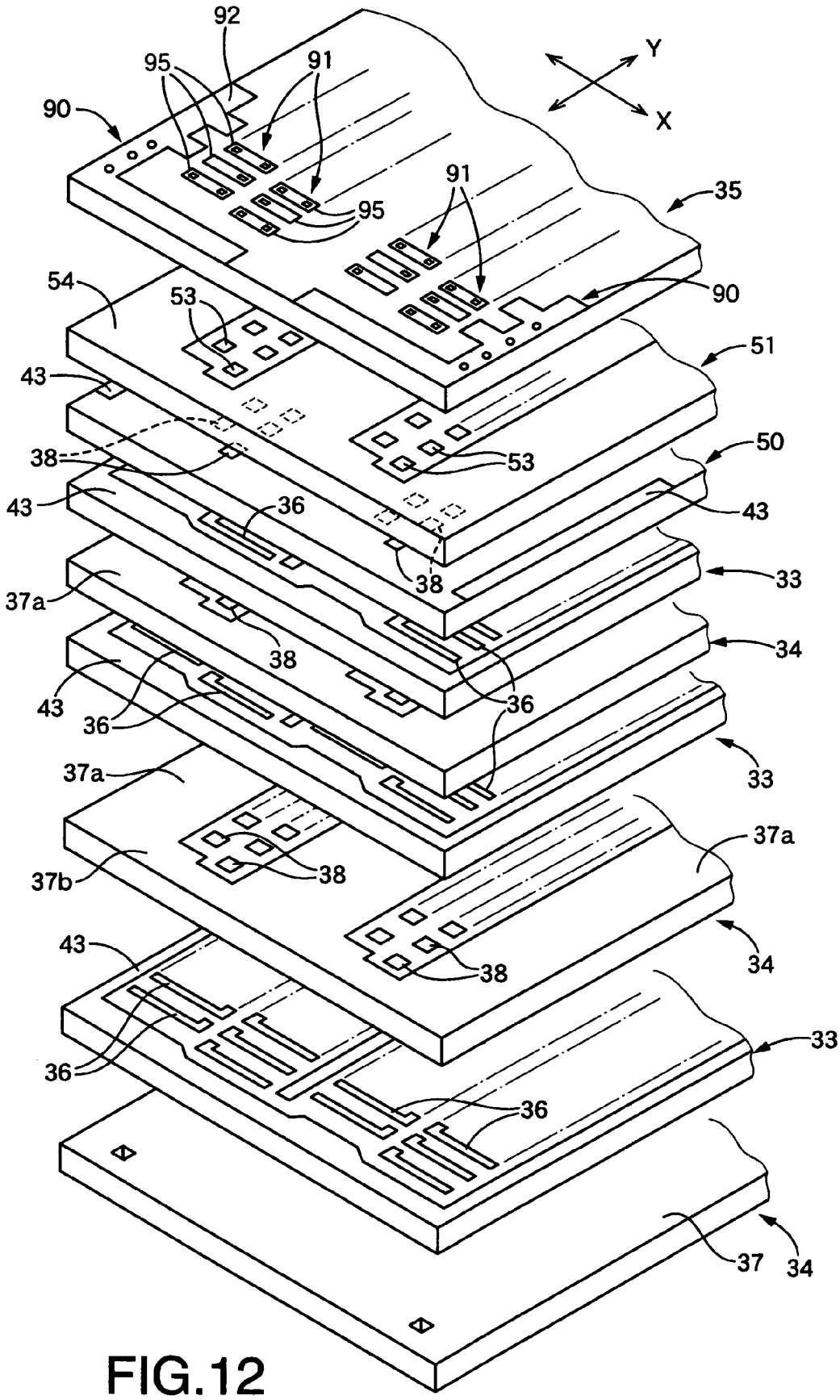
FIG. 12 is an exploded perspective view partially illustrating in enlargement a piezoelectric actuator in an inkjet printhead in accordance with a second embodiment of the present invention.

Alternatively, in the present embodiment, the plurality of nozzles 11*a* are arranged in four coextending arrays, and, as shown in FIG. 12, the plurality of boding terminations 91 for individual connection are arranged, with each being land-shaped, and with all being scattered, on the surface of the top sheet 35 of the piezoelectric actuator 12, in four coextending arrays in a staggered arrangement.

In the present embodiment, as shown in FIG. 12, the piezoelectric actuator 12 is formed as a laminate of the plurality of sheets 33, 34, 35, and sheets 50 and 51.

More specifically, the piezoelectric actuator 12 is constructed to include the first-, third-, and fifth-layer piezoelectric sheets 34, 34, 34, when numbered from the lowermost sheet 34 to the top sheet 35; and the second-, fourth-, and sixth-layer piezoelectric sheets 33, 33, 33; the seventh-layer sheet 50 (constraint layer); the eighth-layer sheet 51 (another constraint layer); and the top sheet 35.

As shown in FIG. 12, similarly with the first embodiment, the common electrode 37 (37*a*, 37*a*, and 37*b*) is formed on the surface (upper face) of each of the first-, third-, and fifth-layer piezoelectric sheets 34, 34, 34. The plurality of dummy individual electrodes 38 are formed on the surface (upper face) of each of the third- and fifth-layer piezoelectric sheets 34, 34, so as to be arranged, with each being land-shaped, and with all being scattered, in a staggered arrangement.

Further, as shown in FIG. 12, similarly with the first embodiment, the plurality of individual electrodes 36 are formed on the surface (upper face) of each of the second-, fourth-, and sixth-layer piezoelectric sheets 33, 33, 33, so as to be arranged in four arrays spaced in the X-direction, in a staggered arrangement, each of which array extends in the Y-direction. The dummy common electrode 43 is formed in the shape of a band on the surface (upper face) of each piezoelectric sheet 33, so as to surround circumferentially each piezoelectric sheet 33. This is also similar to the first embodiment.

In the present embodiment, the seventh- and eighth-layer are each the constraint layer. These constraint layers are provided for constraining the displacements of the aforementioned areas in a direction toward the uppermost top sheet 35, thereby increasing the displacements of these active areas in a direction toward the pressure chambers 23.

As shown in FIG. 12, on the surface (upper face) of the seventh-layer sheet 50, the plurality of dummy individual electrodes 38 are formed, with each being land-shaped, and with all being scattered, in a staggered arrangement, and the band-shaped dummy common electrode 43 is additionally formed.

As shown in FIG. 12, on the surface (upper face) of the eighth-layer sheet 51, the band-shaped communication pattern 54 is formed, and the plurality of connection patterns 53 are formed, with each being land-shaped, and with all being scattered, in a staggered arrangement. These communication pattern 54 and connection patterns 53 are provided for achieving their electrical connection with the plurality of bonding terminations 90 for common connection and the plurality of bonding terminations 91 for individual connection, wherein the bonding terminations 90 and 91 are disposed on the surface of the top sheet 35, which is the ninth-layer or uppermost sheet. These communication pattern 54 and connection patterns 53 are the same as those of the third- and fifth-layer piezoelectric sheets 34, 34.

The seventh-layer sheet 50, the eighth-layer sheet 51, and the top sheet 35 are each made up of the same material as that of the piezoelectric sheets 33, 34. On the other hand, percentages of heat contraction are distributed over the surface of each sheet 33, 34, 35, 50, 51, such that the percentages are higher at an area in which a conductive pattern is formed than at the remaining area.

For this reason, once a laminate formed by superposing these sheets 33, 34, 35, 50, and 51 in a lamination direction undergoes press and firing, in the presence of a large difference in the area size of the conductive pattern between both sides of the piezoelectric actuator 12 (lower layer side and upper layer side) spaced apart in the lamination direction, the laminate is bent to form a concave curved surface on one of the both sides which is larger in the area size of the conductive pattern (i.e., the side of the first-layer sheet 34 on which the common electrode 37 large in area is located).

Then, in the present embodiment, the conductive patters are assigned such that the area size is better balanced between the lower layer side and the upper layer side of the piezoelectric actuator 12, by increasing the area size of the conductive pattern in the eighth-layer sheet 51 when compared with the conventional piezoelectric actuator. As a result, the piezoelectric actuator 12 is suppressed from being curved due to the firing process.

Further, in the present embodiment, the conductive pattern for the eighth-layer sheet 51 is designed to be in common to that for the third-layer sheet 34 and the fifth-layer sheet 34, thereby making these sheets 34, 34, and 51 to be common to each other in terms of components.

In the present embodiment, similarly with the first embodiment, the plurality of sheets 33, 34, 35, 50, and 51 excluding the first-layer sheet 34 are pierced to form the though holes 41, and, such as shown in FIG. 8, each through hole 41 is filled with conductive paste for forming each inner conductive electrode 42, 44 within the corresponding through hole 41.

Via these inner conductive electrodes 42 and 44, the common electrodes 37, the dummy common electrodes 43, and the bonding terminations 90 are electrically connected with each other in the lamination direction of the piezoelectric actuator 12. Additionally, via those inner conductive electrodes 42 and 44, the individual electrodes 36, the dummy individual electrodes 38, and the bonding terminations 91 are electrically connected with each other in the lamination direction of the piezoelectric actuator 12.

Figure 13:
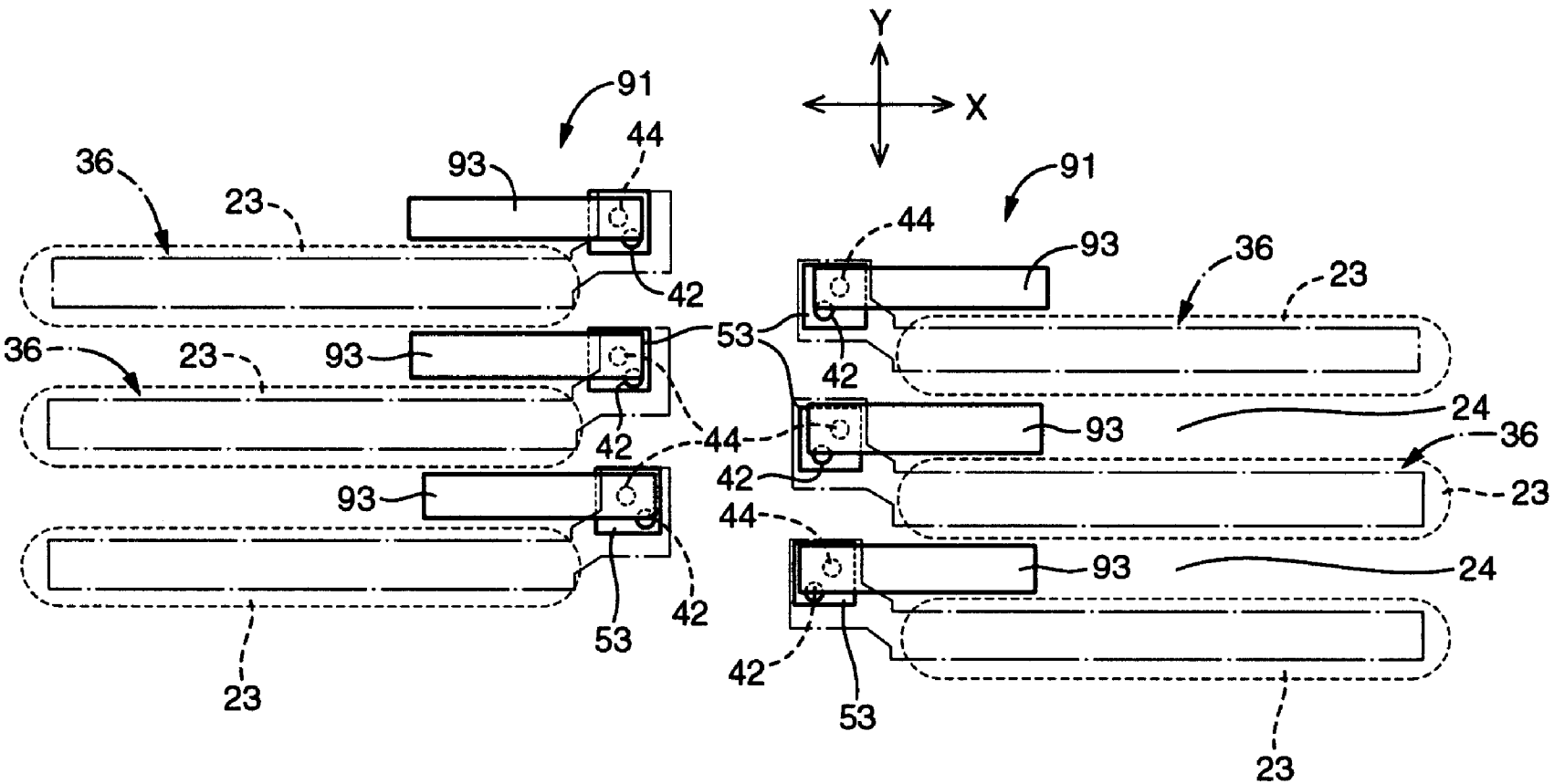
FIG. 13 is an enlarged top plan view partially illustrating a plurality of bonding terminations for individual connection in a top sheet illustrated in FIG. 12, together with a plurality of individual electrodes, a plurality of connection patterns, and a plurality of pressure chambers.

In the present embodiment, the plurality of bonding terminations 91 for individual connection in the top sheet 35 are disposed, similarly with the first embodiment, as shown in FIG. 13, within areas between adjacent twos of the plurality of arrays of the pressure chambers 23, in proximity to each other, in top plan view.

Further, in the present embodiment, these bonding terminations 91 are disposed, as shown in FIG. 13, in phase or coincident, when viewed in the first direction (the Y-direction), with areas between adjacent twos of the pressure chambers 23 arranged in the same array extending in the first direction (the Y-direction), in top plan view.

Therefore, as shown in FIG. 13, in the present embodiment, the positions of the through holes 41 (the positions of the inner conductive electrodes 44) each piercing through the top sheet 35 perpendicularly to the surface thereof, correspond to the positions of the pressure chambers 23 in a staggered arrangement, and the through holes 41 are disposed out of phase or non-coincident with the pressure chambers 23, by a half of the chamber-to-chamber pitch P, in a staggered arrangement, in top plan view. In the same manner, portions of the surface electrodes 93 which are connected with the corresponding inner conductive electrodes 44 are disposed.

More specifically, as shown in FIG. 13, the through holes 41 are disposed adjacent to each other within areas between adjacent twos of the arrays of the pressure chambers 23, in proximity to each other, in top plan view. In the same manner, the portions of the surface electrodes 93 which are connected with the corresponding inner conductive electrodes 44 are disposed.

Further, as shown in FIG. 13, the through holes 41 are disposed in phase or coincident, when viewed in the first direction (the Y-direction), with areas between adjacent twos of the pressure chambers 23 arranged in the same array extending in the first direction (the Y-direction). In the same manner, the portions of the surface electrodes 93 which are connected with the corresponding inner conductive electrodes 44 are disposed.

As shown in FIG. 13, each of the surface electrodes 93 is generally formed so as to extend in the second direction (the X-direction) and is disposed at an area (above the corresponding division wall 24) between adjacent two of the pressure chambers 23 arranged in the same array extending in the first direction (the Y-direction), in top plan view.

Figure 14:
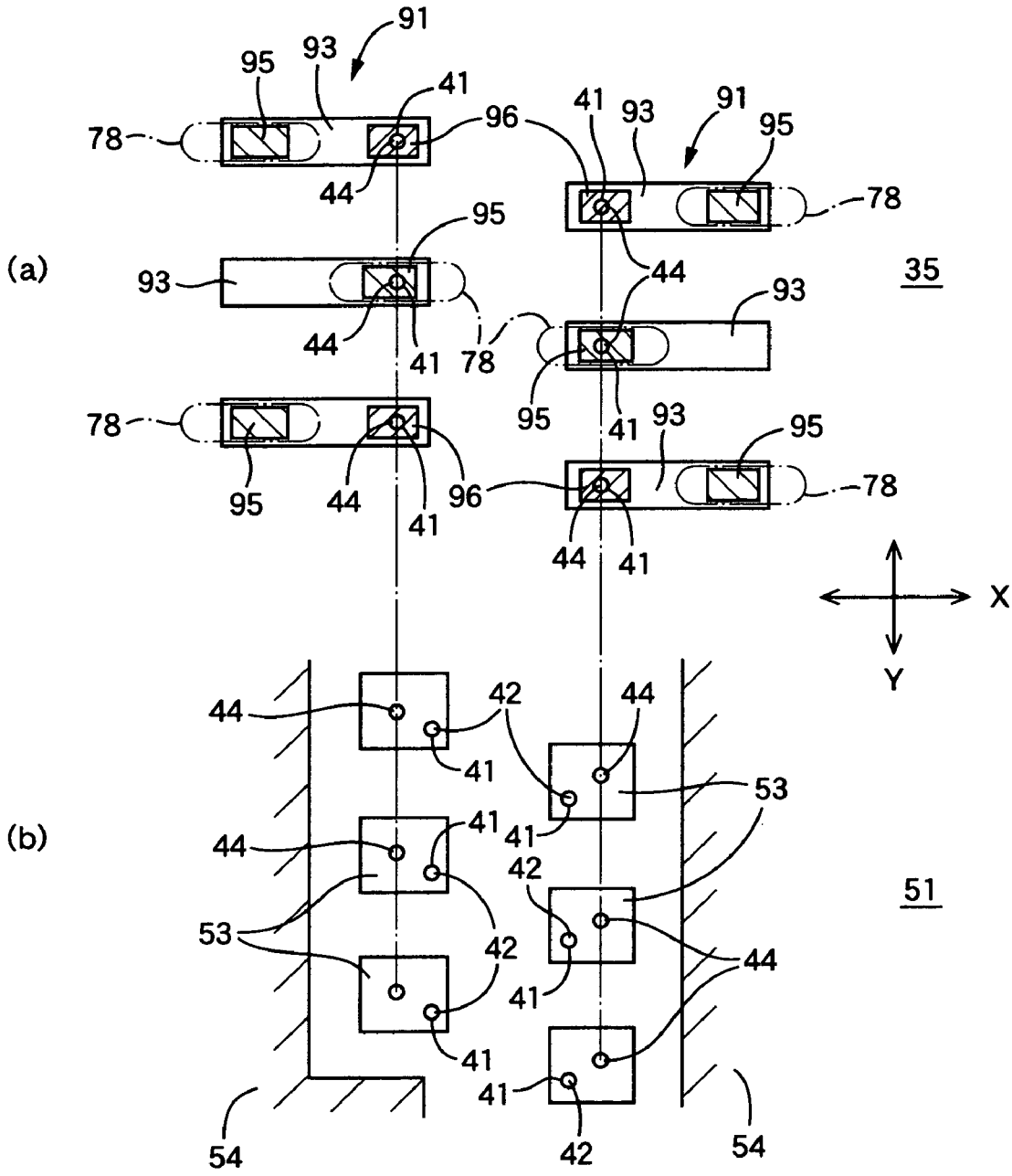
FIG. 14(*a*) is an enlarged top plan view partially illustrating the plurality of bonding terminations for individual connection in the top sheet illustrated in FIG. 12, for explanation of an example of the arrangement of surface electrodes and external electrodes in the bonding terminations for individual connection, and FIG. 14(*b*) is an enlarged top plan view partially illustrating a plurality of connection patterns and a communication pattern in an eighth-layer piezoelectric sheet illustrated in FIG. 12.

FIG. 14(*a*) partially shows in top plan view the plurality of bonding terminations 91 in the top sheet 35, while FIG. 14(*b*) shows the plurality of connection patterns 53 in the eighth-layer sheet 51 in association with the plurality of bonding terminations 91 shown in FIG. 14(*a*) in terms of positions in top plan view.

As shown in FIG. 14(*a*), in the present embodiment, the upper open ends of the plurality of through holes 41 in the top sheet 35 are arranged in parallel collinear arrays in correspondence with the positions of the plurality of arrays of pressure chambers 23, in top plan view. In the same arrangement, the plurality of inner conductive electrodes 44 are formed within those through holes 41, respectively.

In the present embodiment, each external electrode 95 or each dummy portion 96 are provided as an external conductive area formed to overlay or cover the upper open end of each through hole 41 in the top sheet 35 for securing electrical connection of each through hole 41 with each inner conductive electrode 44. These external electrode 95 and dummy portion 96 are formed within the region of the corresponding surface electrode 93 extending in both the X- and Y-directions, while sharing the dimensions in both the X- and Y-directions.

As shown in FIG. 14(*a*), in the present embodiment, each dummy portion 96 is formed respectively on the plurality of bonding terminations 91 arranged in the Y-direction on alternate bonding-terminations, such that each dummy portion 96 is overlapped with the corresponding inner conductive electrode 44 at one of both ends (spaced apart in the X-direction) of the corresponding surface electrode 93. For ones of the plurality of bonding terminations 91 in which the corresponding dummy portions 96 are thus formed, each external electrode 95 is formed at the other end of the corresponding surface electrode 93.

Therefore, in the present embodiment, the plurality of bonding terminations 91 are classified into a first type bonding-termination 91 including both the corresponding external electrode 95 and dummy portion 96, and a second type bonding-termination 91 including only the corresponding external electrode 95, and these bonding terminations 91 are arranged in the Y-direction, such that the first and second type bonding-terminations 91, 91 are alternate in positions in the Y-direction. That is to say, in the second type bonding-termination 91, the corresponding external electrode 95 is used to also play a role of an absent dummy portion 96.

As shown in FIG. 14(*a*), the plurality of external electrodes 95 are disposed on the plurality of bonding terminations 91 arranged in both the X- and Y-directions in a staggered arrangement, respectively, in top plan view, irrespective of whether each bonding termination 91 includes both the corresponding external electrode 95 and the corresponding dummy portion 96 or only the corresponding external electrode 95.

Therefore, the plurality of external electrodes 95 are arranged in both the X- and Y-directions in a staggered arrangement, as well, allowing an easier increase in the distances between adjacent twos of the plurality of external electrodes 95.

As a result, the present embodiment, similarly with the first embodiment, provides effects including such an effect that the clearances between adjacent twos of the plurality of lines in the wiring 79 can be more easily widened, for the plurality of bonding terminations 78 for individual connection which are exposed at the surface of the flexible flat cable 40 to the outside, and which are electrically connected with the plurality of boding terminations 91 in superposed relationship thereon.

As shown in FIG. 14, in the present embodiment, the positions of the through holes 41 in the eighth-layer sheet 51 (constraint sheet) are out of phase or non-coincident with the positions of the through holes 41 in the top sheet 35, in top plan view.

Therefore, the present embodiment, upon pressing the external electrodes 95 formed at portions of the top sheet 35 at which the corresponding through holes 41 are formed, onto the flexible flat cable 40, for bonding thereto, allows the pressing force acting therebetween to be born by portions of the eighth-layer sheet 51 at which the through holes 41 are not formed. As a result, the top sheet 35 or the like is prevented from being unexpectedly deformed due to the pressing force.

It is added that, each external electrode 94, 95, or each dummy portion 96 may be configured to be in the form of a quadrangle (for example, a square, a rectangle, a diamond, a trapezoid, etc.), or alternatively may be configured to have a desired shape, such as a circle or an ellipse, other than a quadrangle.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. An inkjet printhead for ejecting ink droplets for printing, the inkjet printhead comprising:

a plurality of nozzles through which the ink droplets are ejected, disposed such that a plurality of nozzle arrays each extending in a first direction are arranged in a second direction orthogonal to the first direction;

a cavity unit incorporating a plurality of pressure chambers corresponding to the plurality of nozzles, respectively, the plurality of pressure chambers being disposed such that a plurality of pressure-chamber arrays each extending in the first direction are arranged in the second direction; and an actuator including a plurality of energy generation areas selectively imparting ink ejecting energy to the plurality of pressure chambers, respectively, the actuator being in the form of a laminate of a plurality of sheets, and in superposed relationship on the cavity unit, wherein the actuator includes a plurality of individual electrodes corresponding to the plurality of energy generation areas, respectively, and includes a top sheet of the plurality of sheets which is distal from the cavity unit, wherein the top sheet includes a plurality of bonding terminations for selectively imparting electrical energy to the plurality of energy generation areas, respectively, the plurality of bonding terminations being disposed on a surface of the top sheet so as to form individually separated lands, wherein the inkjet printhead is bonded at the plurality of bonding terminations to a plurality of bonding electrode areas of a flexible flat cable, respectively, in superposed relationship thereon, for use in reception of control signals for controlling the inkjet printhead, via the flexible flat cable, wherein the plurality of bonding terminations include a plurality of surface electrodes formed on a surface of the top sheet, respectively, wherein the top sheet includes a plurality of through holes each piercing through the top sheet in a thickness direction thereof, each of the plurality of through holes being filled with a conductive material, wherein the conductive material filling a corresponding one of the plurality of through holes, is locally communicated with a corresponding one of the plurality of the surface electrodes at a communication portion thereof, thereby to electrically couple the corresponding surface electrode and a corresponding one of the plurality of individual electrodes of the actuator, wherein the top sheet includes a plurality of external conductive areas, each formed on a surface of a corresponding one of the plurality of surface electrodes, and each having a thickness larger than that of the corresponding surface electrode, wherein each of the external conductive areas is formed, so as to overlay an open end of the corresponding through hole located in the communication portion of the corresponding surface electrode, and so as to be tightly joined to the open end, wherein each of the plurality of external conductive areas comprises an external electrode bonded to a corresponding one of the plurality of bonding electrode areas of the flexible flat cable, in superposed relationship thereon, and wherein the plurality of surface electrodes are categorized at least into a first surface-electrode group having both the corresponding external electrode and a dummy portion not bonded to any bonding electrode area, and a second surface-electrode group having the corresponding external electrode without the dummy portion.

2. The inkjet printhead according to claim 1, wherein each of the plurality of external conductive areas is formed on the corresponding surface electrode so as to plug the open end.

3. The inkjet printhead according to claim 1, wherein each of surface electrodes belonging to the first surface-electrode group is configured such that the corresponding external electrode is substantially distal from the dummy portion of a same surface electrode.

4. The inkjet printhead according to claim 1, wherein the plurality of pressure-chamber arrays are disposed in a staggered arrangement in which adjacent twos of the plurality of pressure-chamber arrays are staggered in the first direction by a half of a chamber-to-chamber pitch of each pressure-chamber array, wherein the plurality of surface electrodes are disposed in conformity with the staggered arrangement of the plurality of pressure chambers, in a manner that a plurality of surface-electrode arrays each extending in the first direction are arranged in the second direction, and in a staggered arrangement in which adjacent twos of the plurality of surface-electrode arrays are staggered in the first direction by a half of an electrode-to-electrode pitch of each surface-electrode array, wherein the plurality of surface electrodes are disposed, so as to be located in a portion of the top sheet which is between adjacent two of the plurality of pressure-chamber arrays, in proximity to each other, as viewed in a lamination direction of a laminate of the cavity unit and the actuator, and wherein each of the plurality of surface electrodes is formed so as to extend in parallel to each of the plurality of pressure chambers, and is disposed in a portion of the top sheet which is between adjacent two of the plurality of pressure chambers as viewed in each pressure-chamber array, as viewed in the lamination direction.

5. The inkjet printhead according to claim 4, wherein each of the plurality of external conductive areas has a width measured in the first direction not exceeding that of the corresponding surface electrode.

6. The inkjet printhead according to claim 1, wherein the plurality of sheets are constructed by alternately laminating a plurality of first piezoelectric sheets each having ones of the plurality of individual electrodes for each of the plurality of pressure chambers, and a plurality of second piezoelectric sheets each having a common electrode common to the plurality of pressure chambers, wherein each of the plurality of second piezoelectric sheets comprises:

a plurality of through holes each piercing through each second piezoelectric sheet in a lamination direction of the plurality of sheets, each of the plurality of through holes being filled with a conductive material; and a plurality of dummy individual electrodes for allowing electrical connection between selected ones of the plurality of individual electrodes, the selected individual electrodes being located in ones of the plurality of first piezoelectric sheets which interpose each second piezoelectric sheet, the selected individual electrodes corresponding in position to each other as viewed in the lamination direction, the plurality of dummy individual electrodes being formed on each second piezoelectric sheet so as to form individually separated lands, and wherein each of the plurality of first piezoelectric sheets comprises:

a plurality of through holes each piercing through each first piezoelectric sheet in the lamination direction, each of the plurality of through holes being filled with a conductive material; and a dummy common electrode for allowing electrical connection between the common electrodes located in ones of the plurality of second piezoelectric sheets which interpose each first piezoelectric sheet, the common electrodes corresponding in position to each other as viewed in the lamination direction, the dummy common electrode being formed on each first piezoelectric sheet.

7. The inkjet printhead according to claim 6, wherein the plurality of sheets comprise at least one constraint sheet interposed between the top sheet and one of the plurality of first and second piezoelectric sheets, wherein the constraint sheet is electrically coupled with the plurality of surface electrodes of the top sheet via the conductive material with which the through holes of the top sheet are filled, and wherein the constraint sheet comprises:

a plurality of through holes each piercing through the constraint sheet in the lamination direction, each of the plurality of through holes being filled with a conductive material;

a plurality of connection patterns electrically coupled with the plurality of individual electrodes via the conductive material filling the through holes of the constraint sheet; and a communication pattern having a conductive pattern shape identical to that of the common electrode.

8. The inkjet printhead according to claim 7, wherein the plurality of connection patterns each have a conductive pattern shape identical to those of the plurality of dummy individual electrodes.

9. The inkjet printhead according to claim 7, wherein the plurality of through holes of the constraint sheet are out of phase with the plurality of through holes of the top sheet, as viewed in the lamination direction.

10. The inkjet printhead according to claim 1, wherein the plurality of bonding electrode areas comprise:

a plurality of individual surface electrodes disposed on a surface of the flexible flat cable, at respective positions corresponding to the plurality of external conductive areas of the top sheet, the plurality of individual surface electrodes being in an exposed state; and a wiring electrically coupled with the plurality of individual surface electrodes, disposed on the surface of the flexible flat cable, in a non-exposed state.

11. The inkjet printhead according to claim 10, wherein the wiring is coated with a cover-lay.

* * * * *